US011002512B2

(12) United States Patent
Tello

(10) Patent No.: US 11,002,512 B2
(45) Date of Patent: May 11, 2021

(54) FIREARM MARKSMANSHIP SYSTEM WITH CHAMBER INSERT

(71) Applicant: Selso Tello, College Park, GA (US)

(72) Inventor: Selso Tello, College Park, GA (US)

( * ) Notice: Subject to any disclaimer, the term of this patent is extended or adjusted under 35 U.S.C. 154(b) by 0 days.

(21) Appl. No.: 16/989,708

(22) Filed: Aug. 10, 2020

(65) Prior Publication Data

US 2020/0370867 A1 Nov. 26, 2020

Related U.S. Application Data

(63) Continuation of application No. 15/798,329, filed on Oct. 30, 2017, now Pat. No. 10,739,109.

(60) Provisional application No. 62/542,713, filed on Aug. 8, 2017, provisional application No. 62/414,649, filed on Oct. 28, 2016.

(51) Int. Cl.
*F41G 1/54* (2006.01)
*F41A 33/00* (2006.01)

(52) U.S. Cl.
CPC ..... *F41G 1/545* (2013.01); *F41A 33/00* (2013.01)

(58) Field of Classification Search
CPC ..... F41A 33/00; F41A 33/02; F41A 33/04; F41A 33/06; F41G 1/54; F41G 1/545; F41G 3/26; F41G 3/2616; F41G 3/2622; F41G 3/2633; F41G 3/2644; F41G 3/2655
See application file for complete search history.

(56) References Cited

U.S. PATENT DOCUMENTS

| | | | |
|---|---|---|---|
| 3,743,818 | A | 7/1973 | Marasco et al. |
| 3,782,832 | A | 1/1974 | Hacskaylo |
| 4,336,018 | A | 6/1982 | Marshall et al. |
| 4,531,052 | A | 7/1985 | Moore |
| 4,640,514 | A | 2/1987 | Myllyla et al. |
| 4,955,812 | A | 9/1990 | Hill |

(Continued)

FOREIGN PATENT DOCUMENTS

EP 1398595 A1 3/2004

OTHER PUBLICATIONS

Anderson, Gary, "Safety Indicator Adopted for Air Rifles," CMP On-Line Magazine, http://www.odcmp.org/0405/default.asp?page=CBI, website accessed Mar. 8, 2018, predates Oct. 30, 2017, 4 pages.

(Continued)

*Primary Examiner* — Timothy A Musselman
(74) *Attorney, Agent, or Firm* — Schacht Law Office, Inc.; Dwayne Rogge

(57) ABSTRACT

A universal marksmanship training system is disclosed herein configured to utilize a display device comprising a graphic display. A software application may also be provided. The software application is often configured to display a virtual target on the graphic display. A chamber insert may be utilized, the chamber insert configured to be positioned with the firing chamber of a firearm to be zeroed, wherein the chamber insert interacts with the software application to determine alignment of a bore of the firearm to a bore alignment point on the graphic display. In one form, the display device displays a sight target on the graphic display wherein the sight target is visually perceived by a marksman and is offset from the bore alignment point by an offset distance. In one form, the software application calculates the sight target relative to the bore alignment point of the firearm given a set of condition variables.

12 Claims, 23 Drawing Sheets

(56) References Cited

U.S. PATENT DOCUMENTS

| | | | |
|---|---|---|---|
| 5,187,744 | A | 2/1993 | Richter |
| 5,305,381 | A | 4/1994 | Wang et al. |
| 5,454,168 | A | 10/1995 | Langner |
| 5,787,631 | A | 8/1998 | Kendall |
| 6,322,365 | B1 | 11/2001 | Shechter et al. |
| 6,516,699 | B2 | 2/2003 | Sammut et al. |
| 6,572,375 | B2 | 6/2003 | Shechter et al. |
| 6,575,753 | B2 | 6/2003 | Rosa et al. |
| 7,329,127 | B2 | 2/2008 | Kendir et al. |
| 9,335,125 | B2 | 5/2016 | Tello |
| 10,145,653 | B2 | 12/2018 | Tello |
| 10,739,109 | B1 | 8/2020 | Tello |
| 2002/0002788 | A1 | 1/2002 | Hope |
| 2006/0231714 | A1 | 10/2006 | Crain et al. |
| 2007/0137090 | A1 | 6/2007 | Conescu |
| 2010/0092925 | A1 | 4/2010 | Lvovskiy et al. |
| 2011/0207089 | A1 | 8/2011 | Lagettie et al. |
| 2012/0106170 | A1 | 5/2012 | Matthews et al. |
| 2012/0129136 | A1 | 5/2012 | Dvorak |
| 2016/0245620 | A1 | 8/2016 | Tello |
| 2019/0093987 | A1 | 3/2019 | Tello |

OTHER PUBLICATIONS

Hornady, "Hornady (Formerly Stoney Point Overall Length Gauge (Curved)," https://www.dillonprecision.com/hornady-formerly-stoney-point-verall- . . . , website accessed Mar. 8, 2018; predates Oct. 30, 2017, 5 pages.

Hornady, "Hornady-Rapid Rack," https://www.brownells.com/shooting-accessories/training-safety-gear/c . . . , website accessed Mar. 8, 2018, predates Oct. 30, 2017, 2 pages.

International Searching Authority, International Search Report, PCT/US2013/047964, dated Nov. 14, 2013, 2 pages.

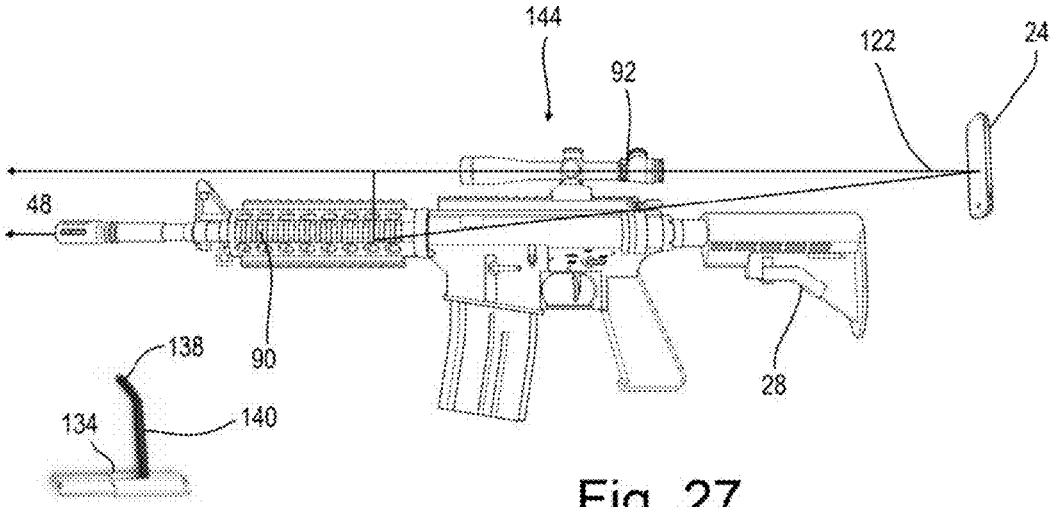
Fig. 27
Fig. 28
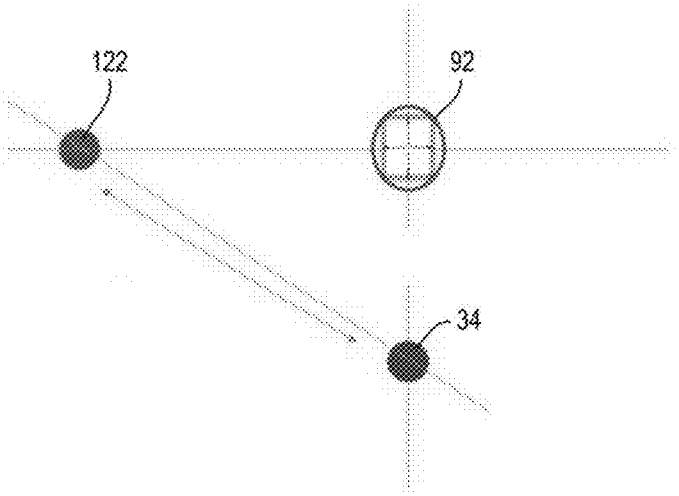
Fig. 29
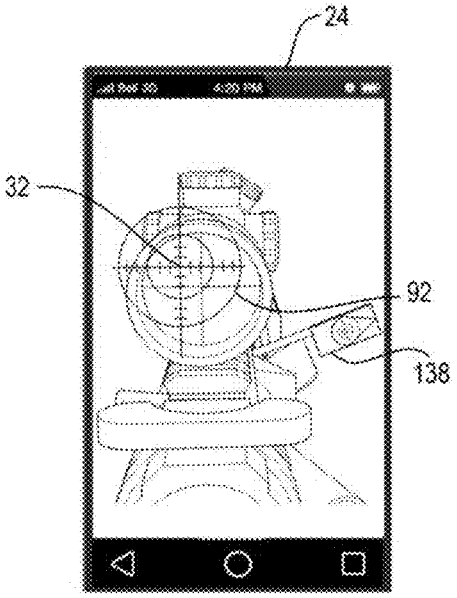
Fig. 30

FIREARM MARKSMANSHIP SYSTEM WITH CHAMBER INSERT

RELATED APPLICATIONS

This application is a continuation of, and claims priority of U.S. Ser. No. 15/798,329 filed on 2017 Oct. 30 which in turn claims priority benefit to U.S. Provisional Application Ser. No. 62/542,713 filed Aug. 8, 2017 and U.S. Provisional Application Ser. No. 62/414,649 filed Oct. 28, 2016, each incorporated herein by reference.

BACKGROUND OF THE DISCLOSURE

Field of the Disclosure

This disclosure relates to the field of marksmanship systems wherein a marksman will zero a live round firearm at a first location, and then apply a virtual sighting/targeting system which simulates the location and conditions of a second, live fire shooting location.

SUMMARY OF THE DISCLOSURE

A universal marksmanship training system (UMTS) is disclosed herein comprising a display device comprising a graphic display which is not mounted to the firearm. A software display application (Display App) may also be provided, configured to display a virtual target on the graphic display. A chamber insert may be utilized, the chamber insert configured to be positioned with the chamber of a firearm to be zeroed wherein the chamber insert interacts with the Display App to determine alignment of a bore of the firearm to a bore alignment point on the graphic display. In one form, the display device displays a sight target on the graphic display wherein the sight target is visually perceived by a marksman and is offset from the bore alignment point by an offset distance. In one form, the Display App calculates the sight target relative to the bore alignment point of the firearm given a set of condition variables.

The training system as disclosed may be arranged wherein the virtual target is representative of a real-life target.

The training system is disclosed in one form wherein the condition variables are selected from the list consisting of: elevation of the real life target; weather conditions expected at the real-life target; and ballistic characteristics of the firearm; ballistics characteristics of the cartridge to be fired; expected distance to the target; and marksman firing offset.

The training system is disclosed in one form as further comprising a display device support arm. The support arm in this form comprising: a first end attached to a barrel end of the firearm; and a second end comprising a display device attachment bracket.

The training system is disclosed in one form wherein the support arm is positionable so as to align the display device relative to the bore of the firearm.

The training system is disclosed in one form as comprising iron sights, an optical sight, and/or a red dot sight.

The training system as recited in claim 1 wherein the chamber insert comprises a laser device. The training system may utilize a magazine having a power supply electrically coupled to the chamber insert. The magazine may otherwise resemble a standard magazine for containment and firing of a set of cartridges. In one form, the power supply comprises a battery.

The training system is disclosed in one form wherein the offset distance is substantially equal to the offset between the alignment point of the sight and the center of the firearm bore at the sight.

BRIEF DESCRIPTION OF THE DRAWINGS

FIG. 27 is a side view of one example of the components shown in the process of FIG. 25.

FIG. 28 is a side view of one example of a chamber insert component of the process shown in FIG. 25.

FIG. 29 diagrams a further step of the process shown in FIG. 25.

FIG. 30 is a screen shot of the step shown in FIG. 29.

DESCRIPTION OF THE PREFERRED EMBODIMENTS

The Universal Marksmanship Training System (UMTS) as disclosed herein utilizes existing technology and allows for future improvements. Currently, the US armed services are deploying training simulations systems and devices that instruct personnel on vehicle driving, weapons marksmanship, combat tactics techniques and procedures (TTPs) from small unit to large fighting formations. Such systems are designed for use with and by the armed services. These systems may be modular or may stand alone and may have the capability to be connected to and interact with a larger network of training and/or tactical components. It is desired in such systems that marksmen utilizing their own firearms 28 before and after sighting (zeroing) their firearm 28 learn the significance of their training in marksmanship experience, maintenance, and clearing malfunctions.

Figure 1:
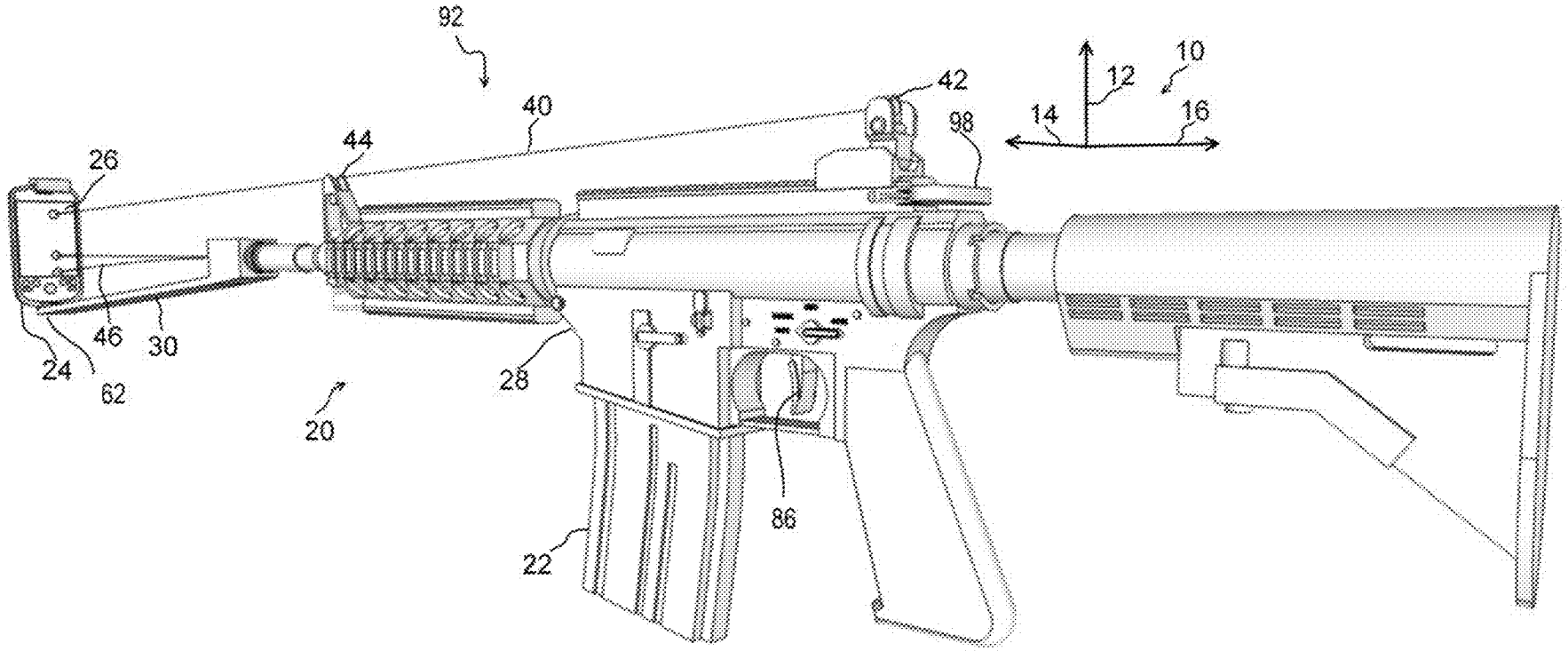
FIG. 1 is a perspective view of one example of the firearm marksmanship system with chamber insert disclosed herein.

Before beginning a detailed description of the novel examples disclosed herein, an axes system 10 is disclosed for ease in understanding of the examples presented. The axes system 10 as shown in FIG. 1 generally comprises a vertical axis 12, a transverse axis 14, and a longitudinal axis 16. The longitudinal axis 16 is aligned with the bore of the firearm. The vertical axis 12 and transverse axis 14 are orthogonal to both other axes. While the term vertical is used to describe the axis 12, as the firearm 28 and other components are moveable/positionable, the vertical direction is in reference to the axes 12, 14 and 16 and is not intended to limit the firearm 28 or UMTS to a particular orientation relative to Earth or any other outside baseline orientation.

The term "zero" is used herein as a version of "to adjust (an instrument or apparatus) to a zero point or to an arbitrary reading from which all other readings are to be measured." In particular, the term is used to denote a condition wherein a marksman (user) has aligned the sights 92 of the firearm 28 with the impact point (live fire or calculated) of a projectile fired from the firearm 28 under specific conditions. Subsequent alignment of the sights 92 of the firearm 28 will result in a projectile fired from that firearm impacting a target at a desired location under real-life conditions. Such conditions may include distance 94 to target (FIG. 12), elevation differential from shooter to target, elevation of range above sea level, temperature, etc.

When firing a non-zeroed firearm 28 at a target 104 (FIG. 12), a marksman fires the firearm 28 and the projectile 106 strikes the target 104, the point of aim 38 (where the marksman has aligned the sights 92) and the point of impact (where the round strikes the target) do not often coincide at the time of firing. The conditions or variables that result in this discrepancy will be accounted for by the marksman adjusting the sights 92 of the firearm 28, as the firearm 28 is zeroed to offset the discrepancy. The marksman will adjust the sights 92 (point of aim 38) up, down, left, or right until the discrepancy (if any) is within an acceptable standard of accuracy in relationship to the point of impact on the target 104. If the marksman can virtually isolate a variable(s) resulting in the discrepancy, and extract the variable(s) from the whole, and if a new variable(s) are accounted for without firing of a projectile 106, then a new sight alignment can be achieved in a virtual scenario representative of a real-life set of conditions and target 104 and the need to fire many expensive and dangerous rounds of ammunition through the firearm 28 to establish a correct sight alignment may be reduced or avoided. This virtual system thus saves wear on the firearm 28 and the cost of ammunition.

The disclosed Universal Marksmanship Training System (UMTS) 20 in one form comprises a Display App specifically written for firearm (generally provided as a rifle) marksmanship in conjunction with the system/hardware disclosed herein. A marksman can provide data to the Display App from a portable weather station, a Global Positioning System, a muzzle velocity measuring device, keyboard, touch pad, database, or other system. The Display App in one form may comprise firearm and bullet (projectile and cartridge) ballistics firing data which are commonly found in ballistic tables. The inputs from chronographs, GPS trackers, portable weather station, and other sources can be incorporated. This UMTS in one example will incorporate several interoperating components in a small easy to carry case.

Figure 9:
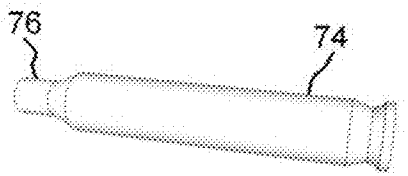
FIG. 9 is a perspective view of one example of a cartridge insert.
Figure 38:
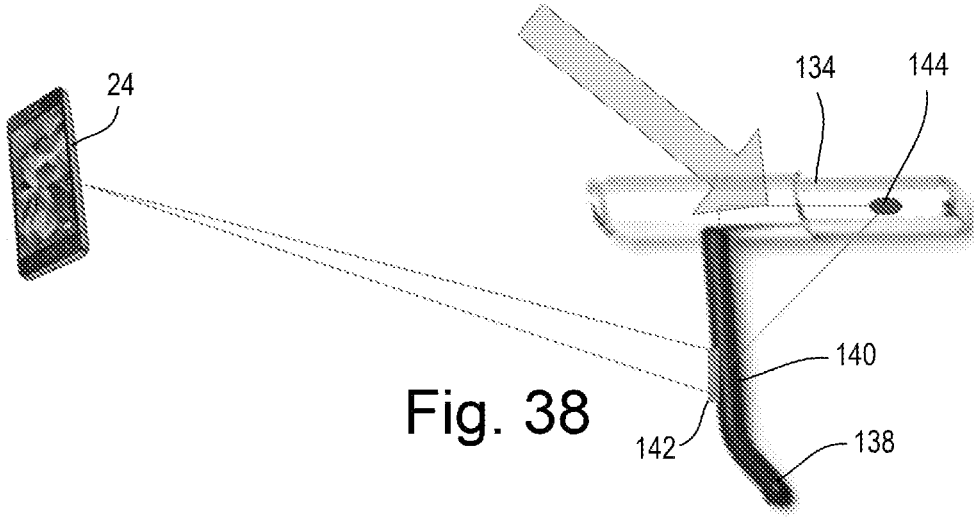
FIG. 38 is a top view of one example of chamber insert component of the example shown in FIG. 27.
Figure 39:
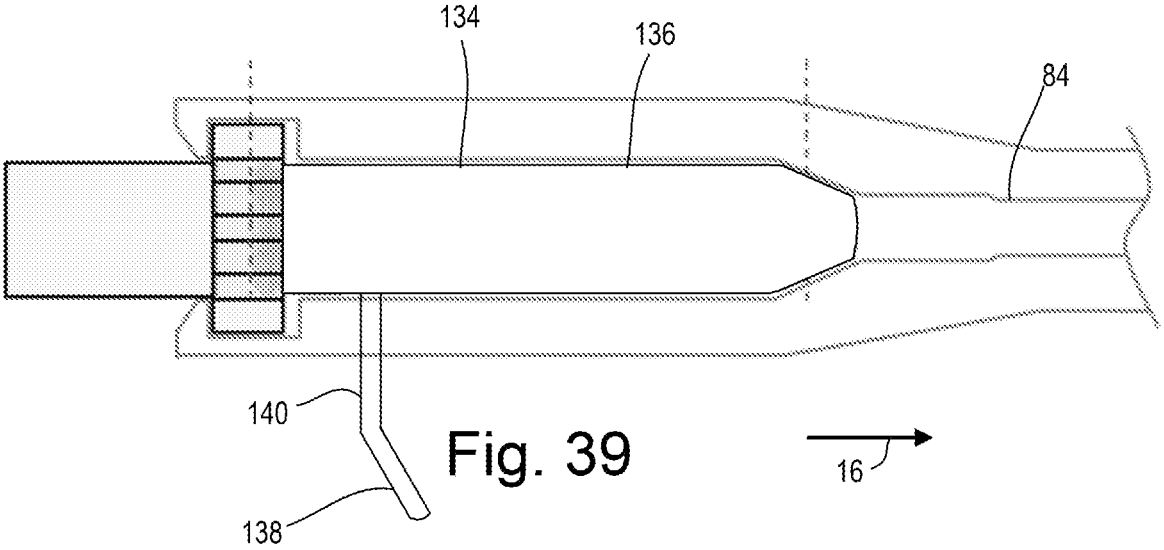
FIG. 39 is a highly schematic view of the chamber insert example shown in FIG. 38 in use.

Hardware. The hardware portions of the system 20 may comprise a chamber insert 74, which may be designed to fit a particular firearm caliber or may be adaptable to fit various caliber firearms. One such a chamber insert 74 (FIG. 13) is disclosed in U.S. Pat. No. 5,787,631 incorporated herein by reference. Another Example of the chamber insert 74 is shown in FIG. 9, other examples shown in FIG. 38, and FIG. 39. In one example the chamber insert will be made to close tolerances to most accurately zero the firearm. Such a chamber insert 74 will align with the center in the bore of the firearm 28 and project an emission beam 36 down the bore of the firearm. In another example, the cartridge insert 74 may house a proximity sensor that interacts with visual data displayed on (and thus emitting from) a graphic display 26. The insert 74 in one example is formed to center in the bore 84 (FIG. 39) of the firearm 28 each and every time it is used properly.

Figure 13:
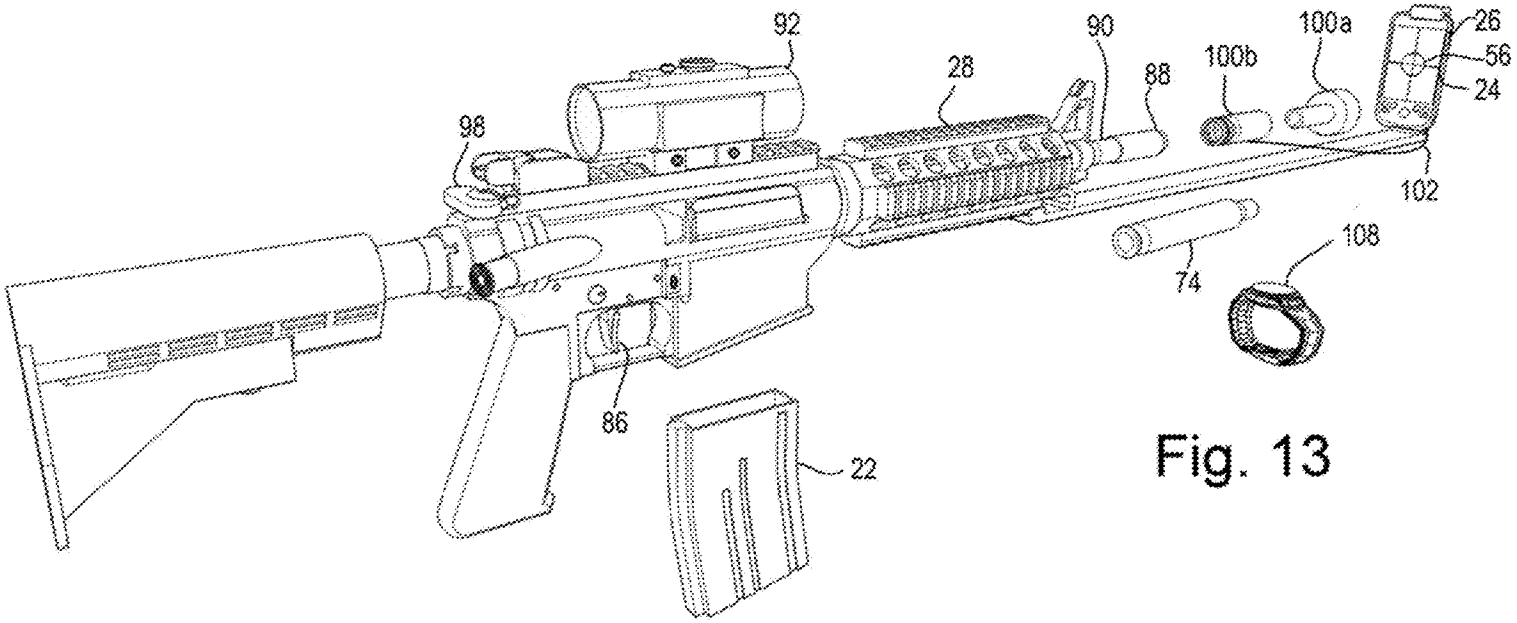
FIG. 13 is a side perspective view of another example of the disclosed apparatus.

In one form, a cartridge magazine 22 as shown in FIG. 1 may include a chamber inset 74 which in turn may comprise a battery or equivalent power storing device to power the chamber insert 74 In addition, laser or infrared sensors 100*a* and 100*b* of FIG. 13 may be utilized with the chamber insert 74. The battery may also power a recoil mechanism that generates a recoil sensation each and every time the marksman actuates the trigger 86; thus simulating firing of the firearm 28. For a self-reloading firearm, a trigger resetting mechanism may be provided. A muzzle velocity chronograph may be utilized to measure muzzle velocity of the projectile 106 fired from the firearm 28. This data may be recorded for analysis later. The chronograph may be set indoors with a method to fire the projectiles 106 safely such as that disclosed in U.S. Pat. No. 4,030,097.

The hardware portions of the system 20 may also include a display device 24 (FIG. 1) having a graphic display 26 (display screen) thereon. While the display device 24 is shown as a cellular (cell) phone; tablet computers, laptop computers, portable televisions, or other portable devices may be used. In one form as shown in FIG. 1, the display device 24 is removably attached to the firearm 28 through a positionable arm 30 with a bracket 62 thereon. The positionable arm 30 as seen best in the examples of FIGS. 2 and 3 has a first end 58 which in this example is attached to the muzzle end 88 of the firearm 28 and a second end 60 having the display device bracket 62.

Figure 2:
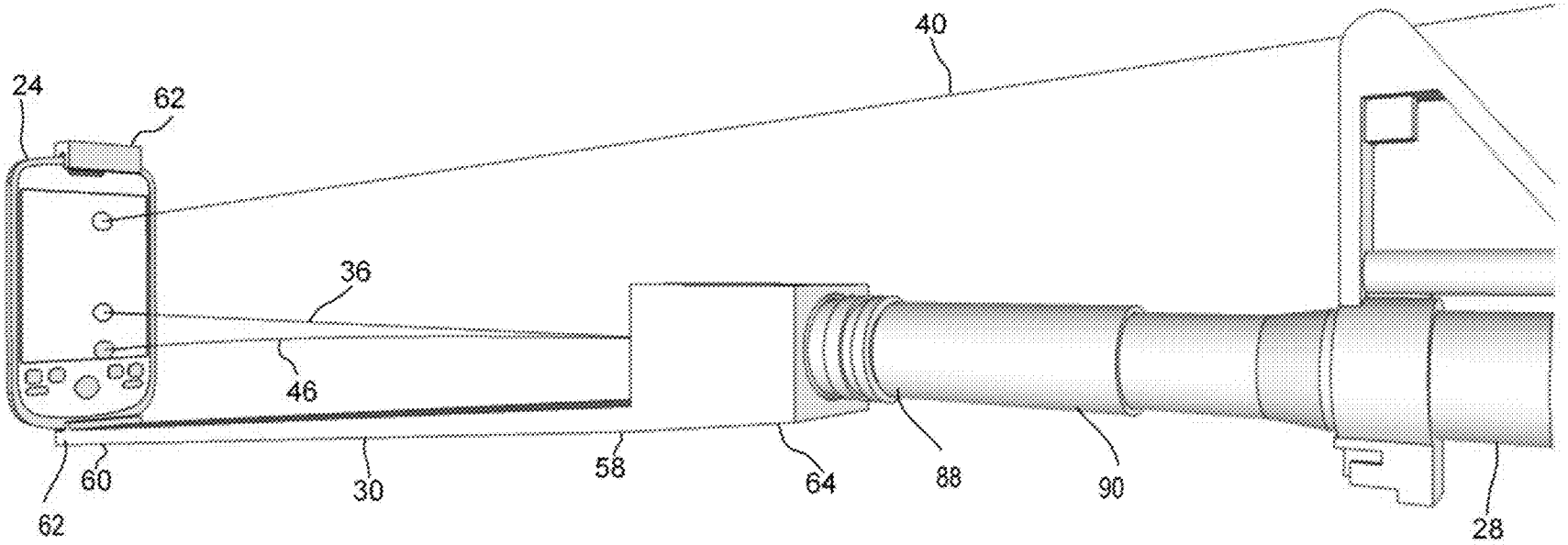
FIG. 2 is a close-up view of the example shown in FIG. 1.

The embodiment of FIG. 2 includes a barrel attachment clamp 64 which removably attaches directly to the barrel 90 of the firearm 28. The embodiment of FIG. 3 includes a Picatinny rail attachment clamp 66 which attaches to a Picatinny rail 68 portion of a hand guard 70 or similar portion of the firearm 28. The positionable arm 30 in one form is made of a malleable material or a series of movable joints such that the first end 58 is positionable relative to the second end 60. In this way, the placement of the display device 24 can be more easily adjusted as desired relative to an emission beam 36 and/or sight line 40.

In another example, shown in FIGS. 16-37 and 43-45 the display device 24 is positioned longitudinally rearward of the sights 92, and may not be attached to the firearm 28. In this example the display device 24 may be held by the shooter or another person and multiple images taken to adjust the sights to the desired setting.

The firearm 28 in one form utilizing the chamber insert 74 will be actuated, and the bore alignment point 34 (FIG. 4) will be visible to the marksman as the point of impact of the emission beam 36 is viewable on the graphic display 26. It may be desired to align the bore alignment point 34 on a specific portion of the graphic display 26, such that a calculated point of impact 32 can be determined relative to the point of aim 38. The point of aim 38 is that point viewed by the marksman when the sights 92 of the firearm 28 are aligned. In FIG. 1 for example, a sight alignment line 40 is shown as an extension of the line between the rear sight 42 and front sight 44.

In the example shown in FIGS. 16-40 and 43-45, the bore alignment point 34 may be calculated by the display device 24 or a separate non transient computing and storage medium detecting the position and alignment of a chamber insert 134 (FIG. 39) relative to the bore of the firearm, and/or the sights of the firearm. The chamber insert fits inside the chamber 136 which is centered on the bore 84 of the firearm 28.

Figure 18:
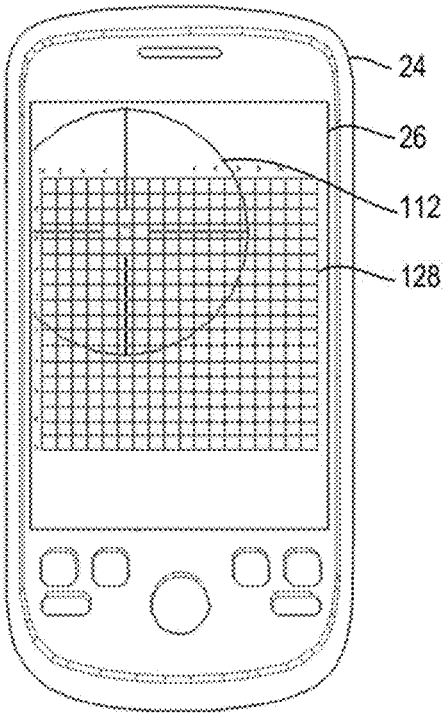
FIG. 18 is a face view of the display device shown in FIG. 16 projecting a live image with a grid.

The chamber insert 134 of this example has a flag 138 which extends exterior of the chamber through. The flag 138 attached to the portion of the insert 134 that is inside the chamber 136 via flag armature 140. This arrangement allows the display device to photograph the flag 138, and/or indicator 142, and thus accurately calculate the longitudinal center 144 and radial center of the chamber 136 and thus the radial center of the bore 84. This is accomplished in one example at the chamber 136 (FIG. 39), rather than at the distal (muzzle) end 88 of the barrel. As seen in FIG. 18, this longitudinal center 144 may longitudinally overlap the sights 92.

Figure 7:
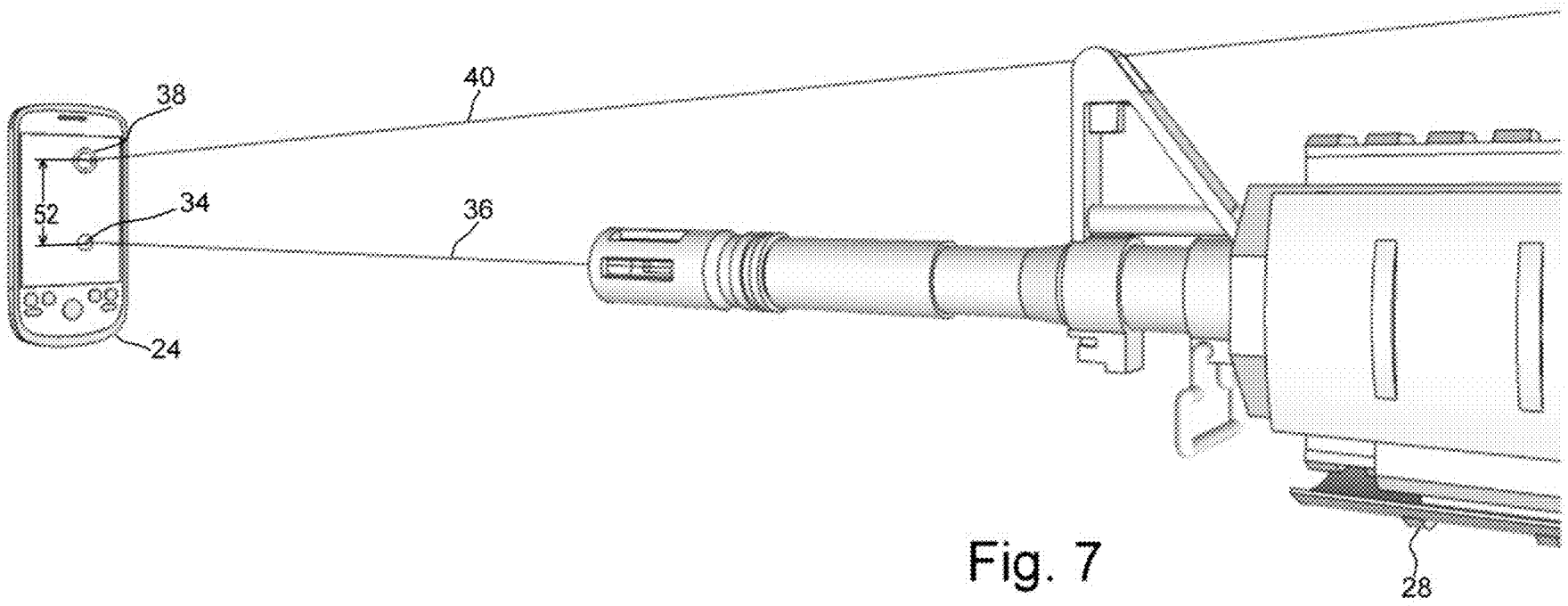
FIG. 7 is a perspective view of the example shown in FIG. 6 when properly zeroed.
Figure 8:
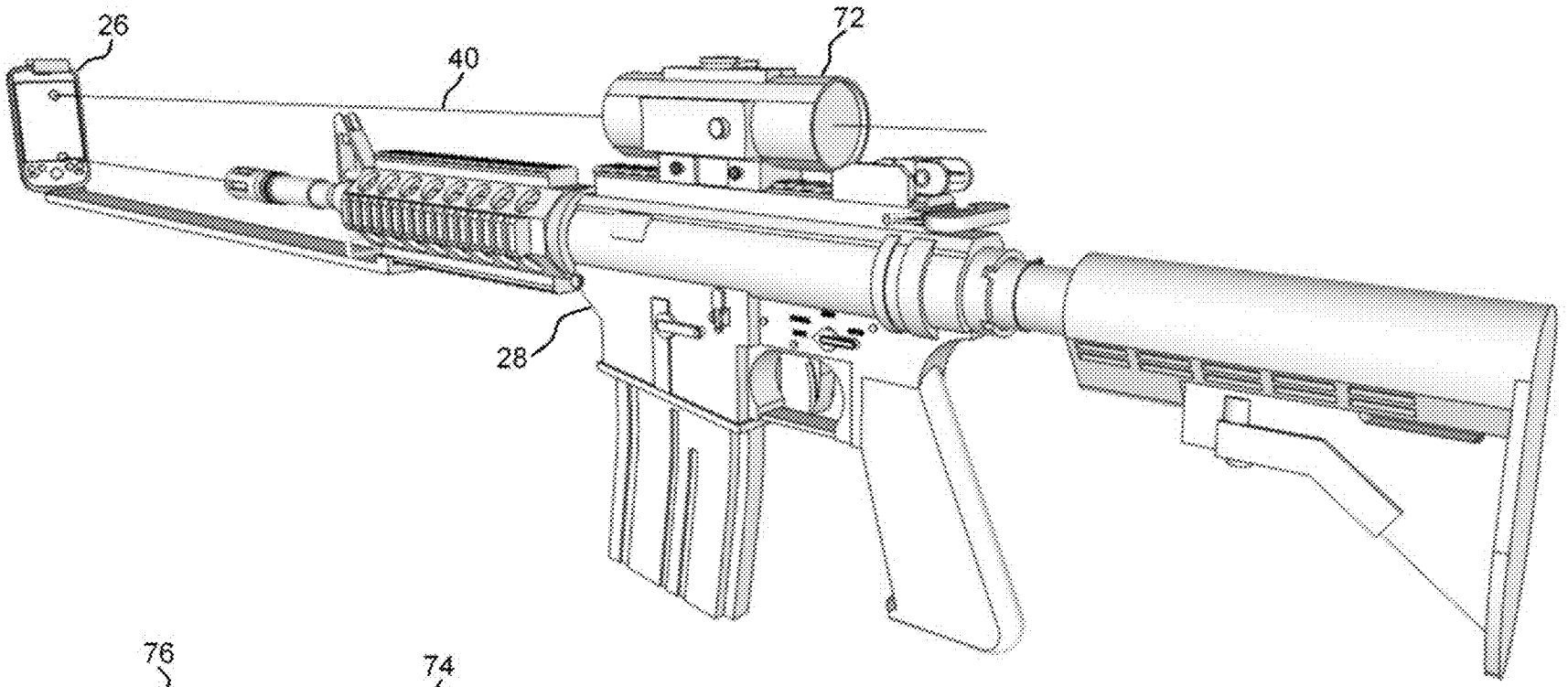
FIG. 8 is a perspective view of an example employing another embodiment of a sight.
Figure 12:
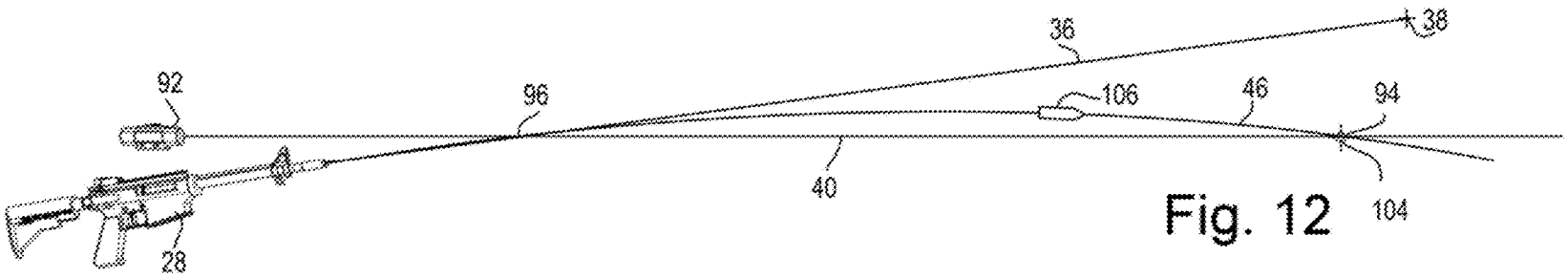
FIG. 12 is a side environmental view one example of the disclosed a live-fire range in operation.

The system 20 of one example is equally useful for open sights (FIG. 1), optical (scope) sights (FIG. 8), laser sights, and other optical and non-optical alignment systems (sights). In each application, the point of aim 38 will be clearly indicated to the marksman familiar with the sight profile of that firearm and may be captured by a camera 122 in the example shown in FIG. 16-31. This allows the display app to calculate the center of bore (144), and point of aim relative to each other. This system 20 displays a correction suggestion to the shooter. In FIG. 12 it can be seen in this example that the sight alignment line 40 extends forward to the target 104, and it is desired for a proper zero that given the conditions at the time of live firing, that the point of impact of a live-fire round (projectile 106) aligns with the point of aim 38. Such a properly zeroed assembly is shown in FIG. 7 and again in FIG. 35 where the bore alignment line 36 is properly positioned relative to the sight alignment line 40. In the simulation as shown in FIG. 4, a proper sight alignment may be achieved when the offset 48 between the point of aim 38 and the bore alignment point 34 corresponds to the calculated offset for specified conditions as described above.

Figure 4:
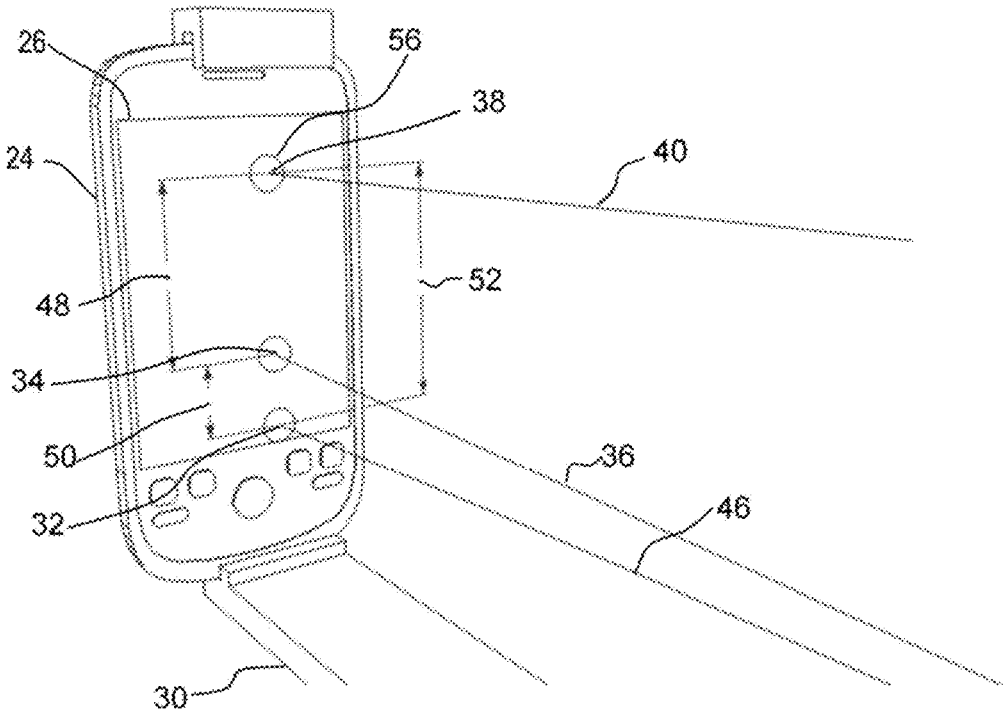
FIG. 4 is an enlarged view of a region of the example of FIG. 1 showing several vertical offsets.

FIG. 4 shows and example where the firearm sights 92 are adjusted such that the bore alignment point 34 is below the point of aim 38, and the calculated point of impact 32. This depicts an example where if the sights 92 were adjusted to this alignment at a real life firing distance, this alignment would not result in a proper zero given the effects of gravity on a live-fire projectile 106 fired at a specified elevation (angle to level), weight, and muzzle velocity. In the example shown in FIG. 4, the display device 24 is much closer to the muzzle end 88 of the firearm 28 than a real-life target 104 would normally be, and this is taken into account by the display app in suggesting a correct alignment. Given a properly zeroed firearm 28, were the sight line 40 extended to the distance 94 of a real-life target 104 as depicted in FIG. 12, a properly aligned sight line 40 would commonly vertically cross the horizontal plane of the bore alignment line 36 at location 96. The downward curvature of the trajectory 46 is generally over-stated in the drawings presented here for ease in description. As previously mentioned, one example of the display device 24 will display a calculated point of impact 32 of the projectile on the graphic display 26.

In one example of the UMTS, the marksman will be able to see a graphical representation of the trajectory 46 of the projectile 106 (if so desired) on another screen presentation on the graphic display 26 relative to the bore alignment line 36 and/or sight line 40.

Figure 41:
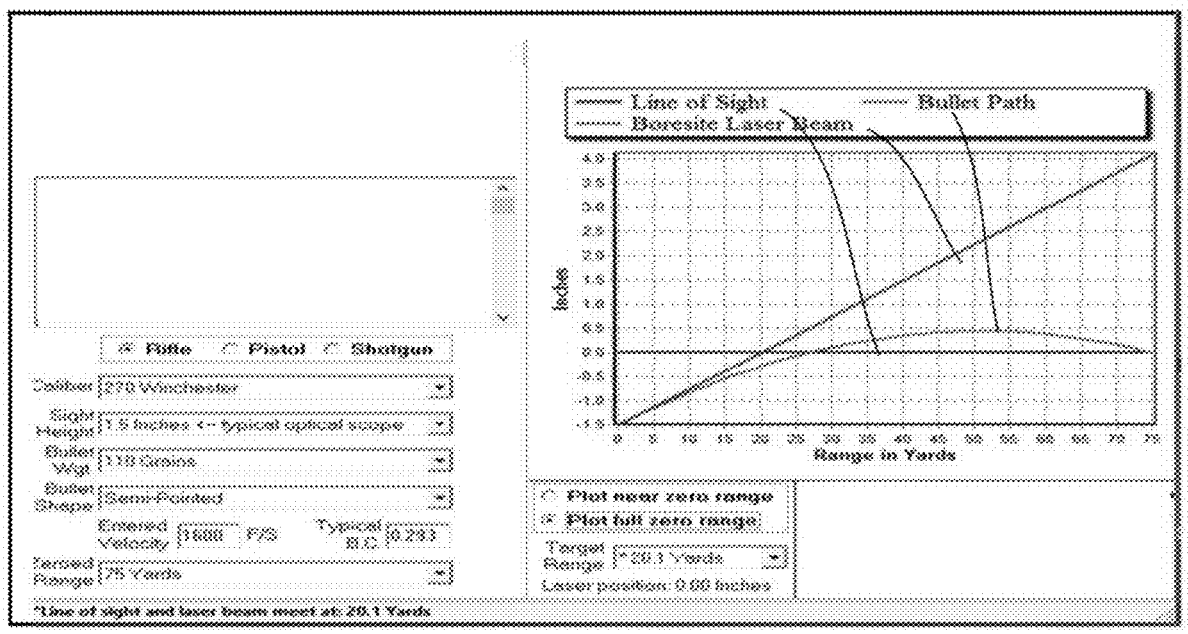
Fig. 41 Prior Art
FIG. 41 is a chart showing a calculated trajectory (bullet path) as well as a line of sight and center of bore line.
Figure 42:
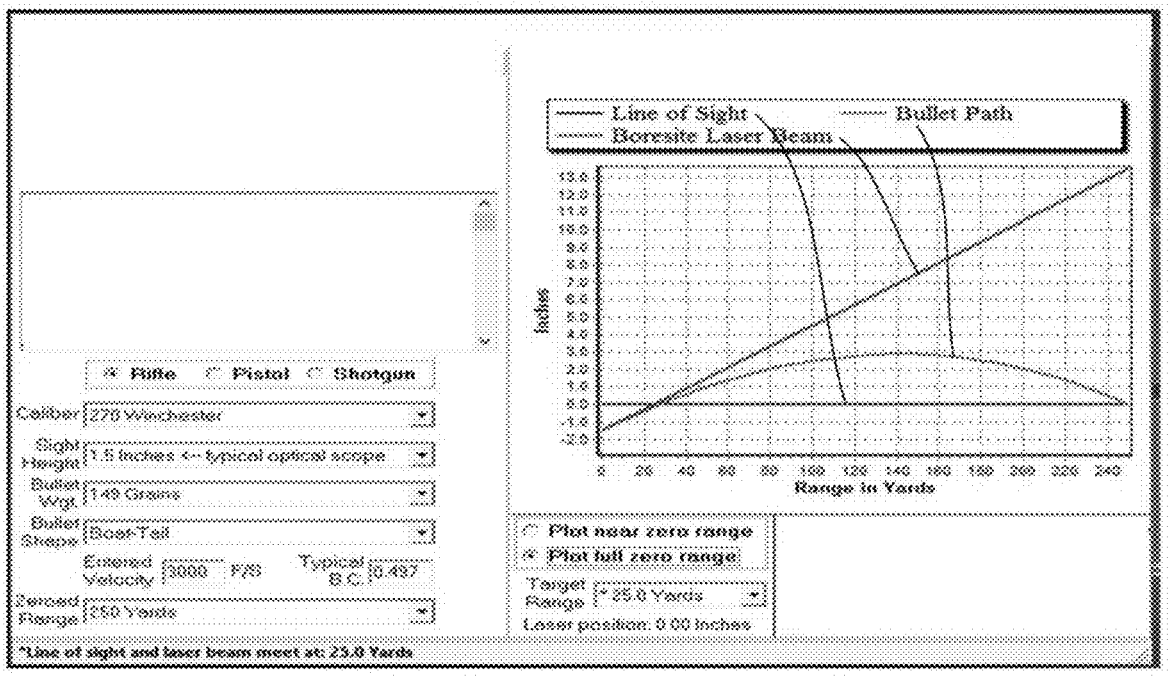
Fig. 42 Prior Art
FIG. 42 is a chart showing another calculated trajectory (bullet path) as well as a line of sight and center of bore line with a different powder charge than that depicted in FIG. 41.

In the carts shown in FIGS. 41 and 42, such a trajectory is shown relative to the line of sight down the sights 92 and the center of bore is also shown relative to the trajectory of the projectile.

If sufficient conditions and variables are known, based on the zero, then the ballistics data, the known firing conditions and other variables can be isolated and the results will indicate the center bore (emission beam 36), the ballistic characteristic of the firearm 28 and the sight alignment line 40 aligned at the distance 94 to which the firearm 28 was zeroed.

The display device 24 as shown in FIG. 4 in one example displays to the marksman a sight target 56, which presents to the marksman a position relative to the bore alignment point 34 from which to zero the firearm in a simulation. When the display device 24 has been configured to the conditions and target desired, the sight target 56 is displayed on the graphic display 26, and the marksman will align the sights with the sight target 56.

In FIG. 4 a first vertical offset 48 is defined between the center of the sight target 56 and the center of the bore alignment point 34. A second vertical offset 50 is shown between the bore alignment point 34 and the calculated point of impact 32. A combined vertical offset 52 is shown as the combined vertical offsets 34 and 50. The first offset 48 will vary dependent on variables such as distance from the firearm 28 to the display device 24, simulated distance to target, projected ambient temperature, humidity, ballistics of the cartridge to be fired, and ballistics of the firearm 28 used. The UMTS system when used in one example allows the marksman to adjust the elevation (vertical angle of the sights relative to the axis of the bore) of the sights 92 properly without firing a single live round and re-zero their firearm to specific conditions.

Figure 5:
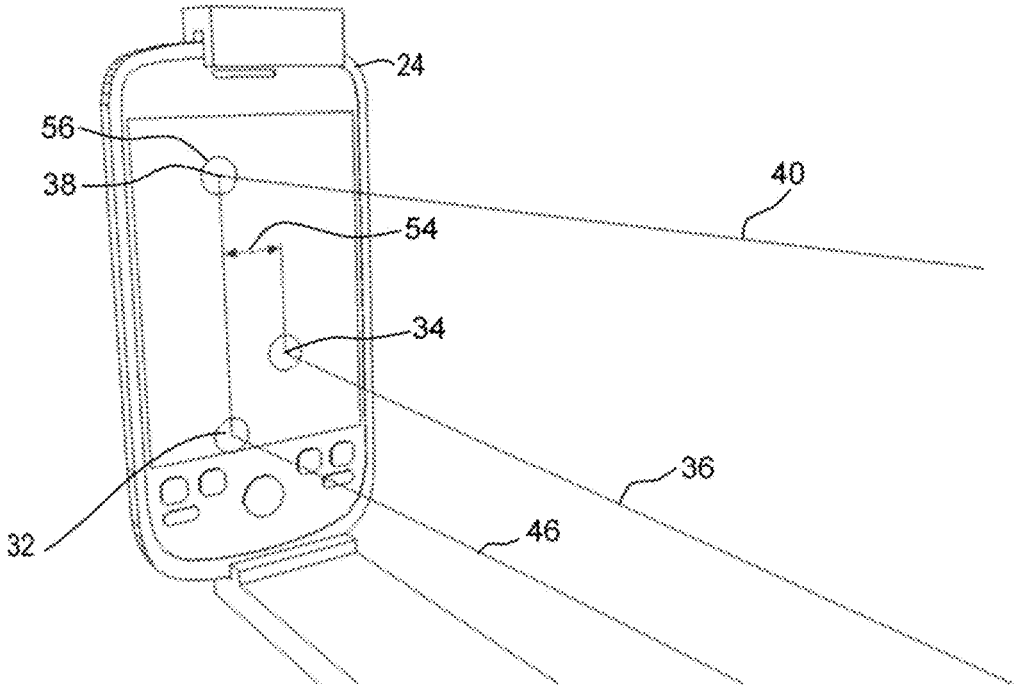
FIG. 5 is an enlarged view of a region of the example of FIG. 1 showing a horizontal offset.
Figure 6:
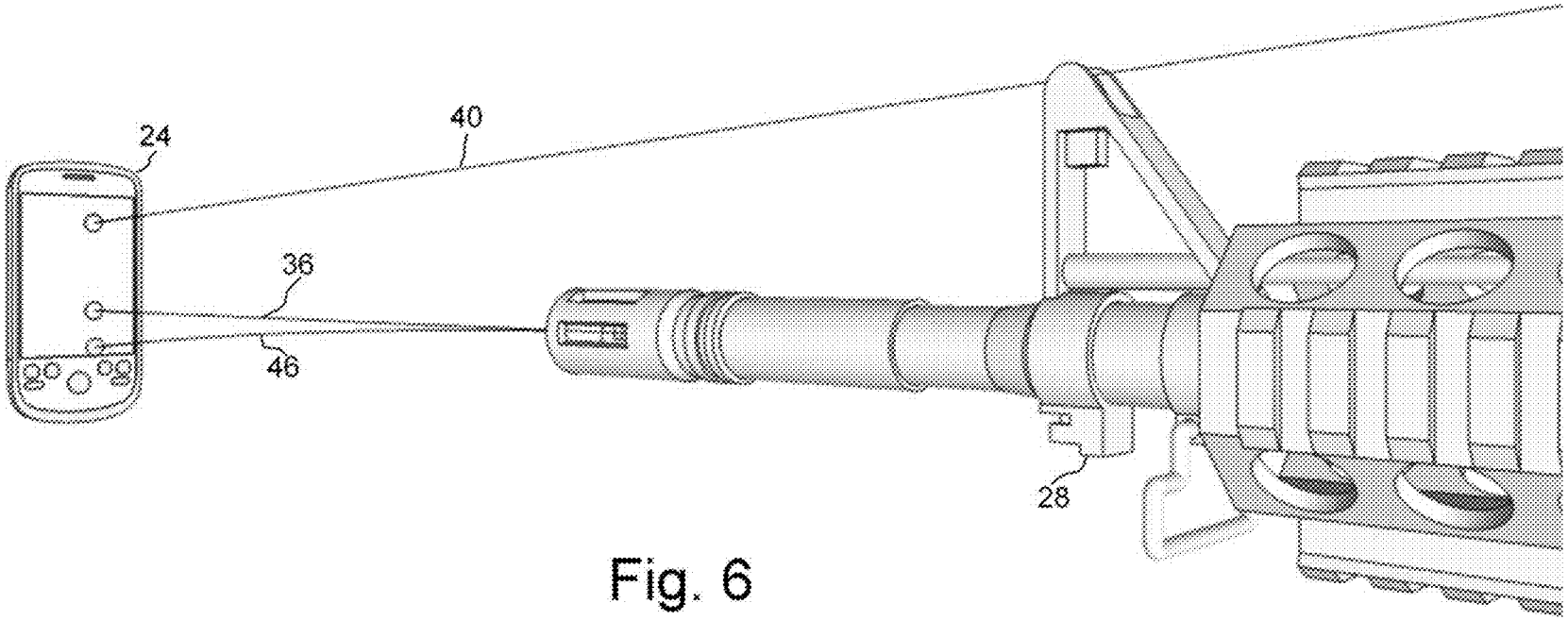
FIG. 6 is a perspective view of the example shown in FIG. 1 wherein the display device is not directly attached to the firearm.

In FIG. 5, a horizontal offset 54 is also shown, between the sight target 56 and the bore alignment point 34. This horizontal offset 54 is presented to account for any horizontal drift due to cross windage, etc. as determined by the variables input to the display device. Generally, this offset is used when a particular shot is to be made and the horizontal effecting conditions are known and can be projected with some certainty.

In the example of FIGS. 16-19 and 43-45 the display app calculates the vertical and horizontal offset of the center of bore from the center of sight, as well as the longitudinal distance from the camera 122 to the center of the bore 84.

Given a properly zeroed firearm 28, a marksman will be able to incorporate data from previous firing session(s) and/or other sources and utilize the display App in combination with data from any previous live-fire session(s) in a virtual scenario. The display device 24 may present (project or display) on the graphic display 26 the calculated point of impact 32, and sight target 56 utilizing the input variables (conditions such as weather, location, ballistic data and muzzle velocity, etc.) provided for a particular shot.

Should the marksman have any circumstance that they suspect may have adjusted the sights 92 out of alignment, the marksman can verify and realign their sights 92 using the calculated point of impact 32 without expending additional live rounds. For example, using the example of the UTMS system shown in FIG. 1, the marksman may re-attach the arm 30 and graphic display 26. The marksman then could visually confirm alignment of the sights 92 with the reticle image 112 as shown by way of example in FIG. 16-19, 25-37, or 43-45.

In one embodiment, the marksman will be able to see the trajectory of a simulation of the projectile 106 (if so desired) on the graphic display 26 in a different display mode (such as that shown in the example of FIG. 12). If the projectile effecting conditions and variables are known, then the bore data and the known conditions and other variables can be isolated to indicate to the marksman an optimum sight alignment.

Step 2. The marksman can change variables in the Display App based on conditions (anticipated and/or known). In response, Display App will account for the change by adjusting the position of the sight target 56 on the graphic display 26 calculated to result in corrected alignment of the sights 92. The marksman can change the variables programed into the Display App in one example by changing the setting(s) in the Display App, engaging the display device 24, positioning the display device 24, and adjusting the sights 92 of the firearm 28. The display App may in one form display the calculated point of impact 32 and/or sight target 56 on the graphic display 26. The variables effecting every shot (firing of projectile 106) can and will change dependent upon variables such as date, time, location, weather, ballistics, etc. The UMTS allows the marksman to take into account multiple variables affecting the shooting of the firearm 28, and allows the marksman to adjust the sights 92 of the firearm 28 against a virtual target (such as the sight target 56) which represents a real life target 104, and then successfully fire a live round at the real-life target without re-adjusting the sights 92 of the firearm 28.

Step 3. The military is researching an option of issuing their marksmen smart phones or similar display/computing devices 24 for use in the field. The Display App disclosed herein is designed to be made a part of an armed forces training platform, so that the teaching and training of the UMTS is conducted with online (internet or intranet connectivity) and is intuitive to the marksman as a requirement before training with a live-fire firearm 28.

For example, marksmen being deployed to a field posting such as for example Afghanistan could be provided a Display App that simulates targets and conditions commonly found at that field posting. The UMTS 20 could account for the most common elevation and weather conditions present in that locale. The Display App of one example will display a simulated three-dimensional version of the target wherein the display device 24 is coupled to an accelerometer, gyroscope, magnetometer, or other position sending devices, such that movement of the firearm 28, arm 30 or other attachment component, and display device 24, move as a unit to present to the marksman a moving environmental display of the target and the surrounding environment. As the marksman pans the firearm 28 to the left for example, the display could pan to the right, maintaining the illusion of a real-life target moving in an environment.

Adjustments to the offsets 48-54 could also be displayed in real-time as the marksman elevates the firearm 28, or for example as the relative angle to expected windage varies.

Step 4. The Display App may gather input (data) from low cost to no cost data to provide a first layer software data analysis. This first layer data analysis may be appended with a second layer of proprietary software (Computation App) which combines the first layer analysis in combination with a chamber insert 74 or equivalent beam emitter. In one example, the Display App and the Computation App are one and the same physical component.

Training. In one example, a marksman's live fire zero of the firearm zero sets the base line from where all additional variables can be measured. The chamber insert 74 in one form provides a method to virtually zero the firearm 28 and take into account multiple conditions as stated previously.

In one example, the UMTS 20 may be presented as an interactive training game, such that the marksman can verify the zero while simultaneously being entertained by the UMTS.

With a correct zero set, the marksman can determine the effecting variables to subsequent shots, and account for these variables prior to firing live rounds through the firearm 28. Such variables can be determined from GPS data, weather, ballistics characteristics of the particular round (cartridge) to be fired, etc.

Savings. The UMTS in several embodiments is particularly beneficial in saving money in wear of the firearm 28 including moving components, barrel 90 and ammunition expenditure. The firearm 28 will not have to fire any rounds when adjusting the sights 92 to a new firing situation/target and the marksman may need only to verify their zero or determine new muzzle velocity reading based on particular cartridge ballistics.

Education on Ballistics. Due to the engagement of the marksman in determining an inputting the factors that impact the trajectory 46 of a projectile 106 and the impact location of the projectile 106 on the target 104, the marksman is repeatedly exposed to ballistics variables. Constant feedback may be provided to the marksman every time the conditions are changed, educating the marksman and improving accuracy and efficiency over time.

The UMTS in one form may determine what the relevant factors of the ballistic equation. The ballistics characteristics of the firearm 28 itself, the location of the shot and the experience and skill of the marksman each play a part in accurate firing of the firearm 28. These variables can be isolated and can be input into the Display App to assist the marksman in zeroing their firearm 28 correctly. There are also variables which cannot be accounted for such as human error (marksman firing offset) in an individual shot, and hardware discrepancies such as manufacturer tolerances of an individual cartridge, powder shift within an individual casing, weapon fouling, etc.

In one example of use, a marksman will fire the firearm 28 using live rounds to gain a basic comprehension of shooting. A trainer may then further instruct the marksman in basic marksmanship and with repetition the marksman's abilities will improve. The marksman may then proceed to some type of recorded live firing to measure their performance with the firearm 28. Where possible, the firearm and ammunition performance could be captured and recorded. The weather (windage, rain, barometer, etc.) at the time of recorded live firing could also be measured and accounted for. The location (elevation above sea level, temperature, weather, etc.) of the live fire range could be accounted for such that the effects on the projectile 106 (bullet) as the projectile 106 moves to the target 104 can be isolated and accounted for. How the marksman applies their experience/training and the mistakes (errors) they make may be captured and also accounted for. Other non-human variables such as measurement of the earth's movement (rotation), weather effects, and inherent errors such as tolerances in firearm and ammunition production that contribute to probable errors in distance and direction may also be calculated and accounted for. As the marksman gains more experience, the human errors should become less significant and become acceptable as the probable error in distance and direction provide a measurement of assurance within the skill of an expert marksman.

Most marksmen adjust the sights 92 of their firearm 28 to align with the impact of the projectile 106 on the target 104 at a specific average distance 94. As previously discussed, this process is commonly termed as "zeroing" or "sighting" the firearm 28. As previously discussed, to zero is defined as accounting for the factors that offset the point of impact 32 from the point of aim 38. Sights 92 can be adjusted left, right, up or down as desired/required to adjust the point of aim 38 relative to the point of impact 32 on the target. The marksman may also utilize a chronograph or equivalent apparatus to determine the muzzle velocity of the firearm 28 and life-fire cartridge. By recording live fire results of each marksman, gains in the effectiveness of the marksman could be recorded and supported by specific instruction. The beginning marksman would be introduced to the shooting fundamentals and trained on the UMTS, and the variables that can be accounted for before a beginning marksman proceeds to a life-fire range would be incorporated in their initial adjustments of the weapon sights 92. Later as the marksman becomes more skilled/proficient, the intuitive nature of the shooting process would further improve the effectiveness of the process.

The start of the software application (App) may be described as follows: Situation 1. In one example, once the firearm 28 has been zeroed such as in a live-fire environment, the components used in one example which work together to enable the UMTS to function as intended include: the chamber insert 74 or equivalent beam emission or alternatively the chamber insert 134, the display device 24, the firearm 28, an optional display device bracket 62, and the display App.

The chamber insert 74 in one example provides the emission (laser) beam 36 through the bore 84 when the trigger 86 is actuated, and may also reset the trigger 86 so that the trigger 86 does not have to be manually reset. Without such a resetting apparatus, the trigger 86 and firing mechanism may need to be manually reset such as by pulling a charging handle 98. In one chamber insert example, when the trigger 28 is actuated the emission beam 36 projects down the barrel 90 and is received by a receiving component 100 (such as a camera, Cds photoresistor, at the muzzle end 88 of the barrel 90, or is visually perceived as it reflects off a target, such as the graphic display 26.

The receiving component 100 in one example as shown in FIG. 13 is connected to the display device 24 by a data wire 102 used by the display device 24. Components 100*a* and 100*b* are examples of the receiving component 100. In one example, once the display device 24 is engaged (turned on), connected to any peripherals or power supply, and the Display App is configured to receive data (such as bore alignment point 34) from the chamber insert 74. The chamber insert 74 is normally centered in the bore 84 of the firearm 28, and is configured to standard tolerances of the ammunition case such that when the emission beam 36 or is actuated, the emission beam 36 traverses the length of the bore 84, exits the barrel 90 of the firearm 28, and impacts the display device 24, if the display device 24 is properly positioned. After the emission beam 36 is activated, the Display App will register the location of the bore alignment point on the display device 24. The Display App in one example will present the bore alignment point 34 on a target with a gird (FIG. 18). The distance 94 between a live-fire target 104 and the firearm 28 in one example may vary from 25 to 1000 yards or more, although the distance between the firearm 28 and the display device 24 may be much shorter. In one example the distance from the muzzle end 88 of the firearm 28 to the display device 24 will be on the order of 6 to 36 inches.

The sight target 56 and the sights (iron sights, scope, or red dot) will be substantially at the same vertical height (offset 48) above the bore 84 of the firearm 28. This will be accomplished by the Display App displaying the sight target 56 at a calculated distance relative to the bore alignment point 34. Once the center of the sight target 56 is aligned with the point of aim 38, then the zero of the firearm is established and can be recorded. In one form the virtual sight target 56 is viewed at a simulated distance.

Situation 2. If the firearm 28 was not previously zeroed then the sights 92 may be adjusted relative to the bore alignment point 34. This will align the point of aim 38 relative to the bore alignment point 34.

The software component (Display App) of the Universal Marksmanship Training System 20 in one form incorporates integrator software or programmed hardware that ties layers of applications to produce an alternate, cost efficient method to maintain a firearm sight alignment and a marksman from having to overly fire their firearm after the sights and firearm's bore alignment point are aligned (zeroed). The term software will be used herein relative to both software and programmed hardware for ease in description of the disclosure. The integrator software also may be configured as an application (app) in a display device 24 such as a smart phone, ITouch, IPad, laptop, tablet, dedicated device, or desk top computer having a graphical display 26. The term "graphic display" will be used herein to refer to the display portion 26 of all such display devices 24.

The integrator software provides a sight target 56 in one example taking into account the conditions (weather, location, weapon/ammo performance, ballistic computation, etc.) that affect the trajectory of a live-fire bulletin flight from the firearm 28 to a target distance 94. Such conditions may be provided by the user (shooter) or may include global mapping data, weather data, etc. The integrator software in one example takes into account the known conditions to isolate the calculated trajectory 46 of the projectile 106 that can be attributed to the marksman, (training, climate effect, steadying hold factors, and state of mind) and that are difficult to quantify. These conditions will be termed "residuals" herein. The equation which predicts the projectile (bullet) flight is a combination of weather (W)+location (L)+weapon/ammo performance (A)+ballistics computations (B)+residual (R). In one form, the integrator software is coded into the Display App and/or Commutation App.

As previously defined, a marksman having aligned the sights 92 with the firearm's projectile point of impact with a particular set of conditions (W,L,A,B) is said to have zeroed the firearm 28. Given that the known conditions (W,L,A,B) when the firearm 28 was zeroed are not commonly replicated in the field the same as when the firearm was zeroed, the current field conditions can be accounted for and the residual can be added to a new set (N) including new weather (NW), new location (NL)+new weapon/ammo performance (NA)+ballistics computations (NB) of known conditions. The deviation from the previous zero to the new zero is termed the "tolerance" in the instruments that measured W, L, A, B and the change in the R getting smaller (more training). So, R+NW+NL+NA+NB=new zero.

In order to determine the residual (R), the Integrator (I) software may incorporate data from (1) weather station type software that can measure real time conditions (2) GPS type software/hardware that can determine latitude, longitude, and or elevation to calculate the effects on the trajectory 46 of the projectile 106 (3) firearm type and ammunition data software (ballistics tables) that can be used for calculation and for storing (cumulative) inputs based on the same ammunition lot. A chronograph or other device may be used to measure the velocity of the projectile 106 (bullet) to determine the performance of the weapon/ammo combination. In addition (4) ballistics software or ballistic lab may be utilized for ballistic computation.

The marksman may conduct the firing of live rounds at a firing range to align the sights 92 with point of impact (zero) in a standard live firing manner. Additionally fire live rounds may be fired through a chronograph to determine muzzle velocity of the projectiles 106. Once the point of aim of the sights 92 and the impact of the projectiles coincide at a particular set of conditions (distance etc.), the marksman has zeroed the firearm 28 to those conditions. Once zeroed, more live rounds may be fired to those conditions to measure reliability of the firearm 28 and the ammunition. Sufficient live rounds may be fired until the marksman is consistently able to place the live fire rounds within the limits of a dispersion pattern (group) on the target 104. Once the marksman consistently fires an acceptable group, the firing conditions and other data such as sight alignment may be recorded. At this point the chronograph may (again) be used to measure the performance of the firearm and the ammunition.

The UMTS in one form may be configured to integrate into the currently provided simulators or may alternatively stand alone and deliver a zero based on the best available data or an accurate predicted zero with a residual determined from a prior live firing. For a given scenario that involves an engagement with an opposing force, experience with a properly zeroed firearm 28, trained marksmen, and rehearsed TTPs would in a virtual simulation be expected to generally provide a higher survival rate in a live fire combat situation. One key to improved performance is then is accurate marksmen with practiced TTPS. The UMTS provides a way to achieve accurate marksmanship with prediction and simulation and fewer life fired rounds.

The variables desired to know for predicting an accurate zero in one example include (1) marksman's location, (2) distance 94 to the target 106, (3) known and recording of weather conditions, (5) firearm and ammunition performance and (6) a system of analyzing and assigning a value to each of these conditions. These conditions may be accounted for and presented to the marksman on the graphic display 26. These conditions may be simulations of are real-life presentations virtually displayed during the zeroing or simulated firing of the firearm 28.

Figure 3:
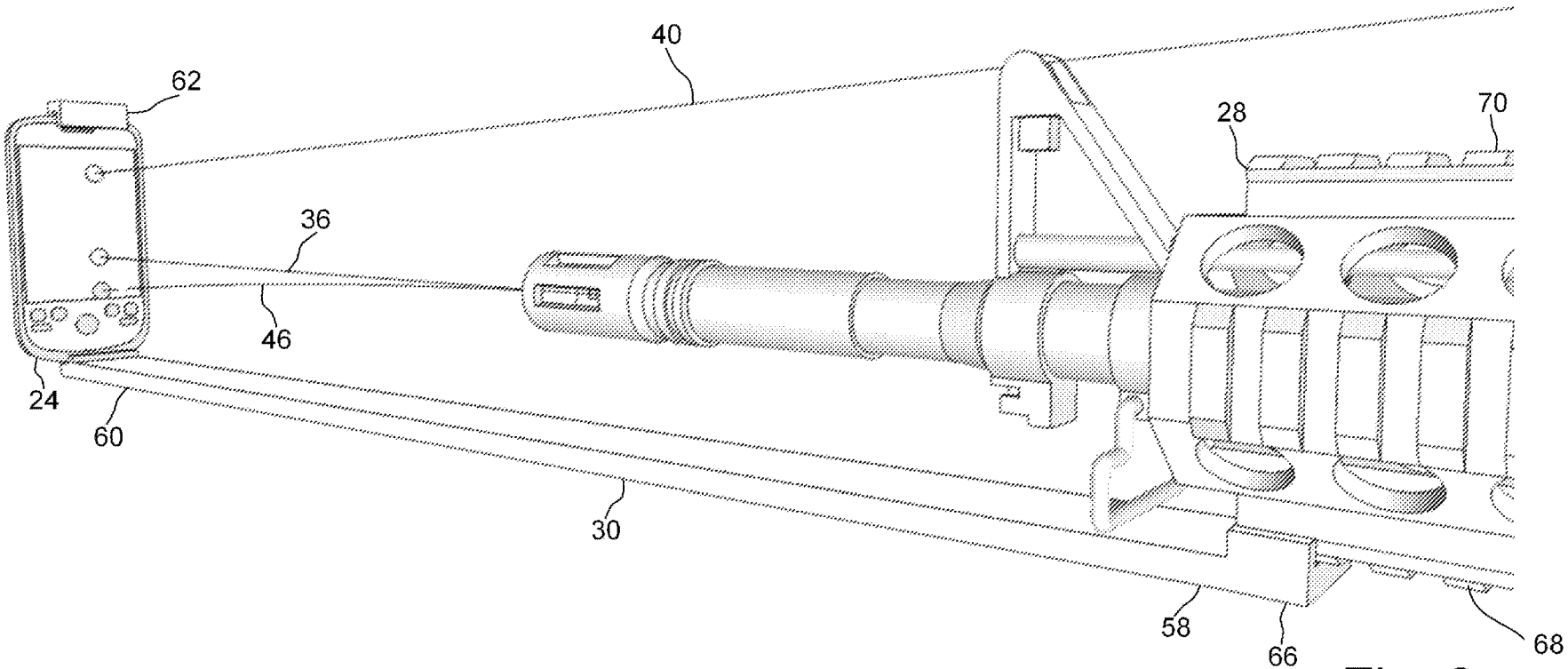
FIG. 3 is a perspective view of an alternate example to that shown in FIG. 1.

In one example, the system 20 may be provided in two parts. The first part may be a Display App that can run on smart phones or equivalent display devices 24, and the second part would be a computer program (Computation App) that may operate on a desktop, tablet, or laptop computer remote of the display device 24. In another example, the Computation App is incorporated into the Display App. The Display App may incorporate data provided by the marksman or a database that provides for example weather and GPS locating data and apply those conditions to the residual. The Display App would then determine the effects of the conditions on the trajectory 46 of the projectile 106 and add these non-standard conditions to the residual and determine the deviation for a new predicted zero. The predicted zero sight target 56 would be properly displayed on the graphic display 26 that in one example may be attached to the weapon as shown in FIG. 1, 2 or 3.

The Computation App in one example could compute any deviation from the center of bore (emission beam 36) as measured from the emitter 76. In one example, the emitter 76 is actuated every time the trigger 86 is actuated. One example of the hardware and/or software used to accomplish this computation is described in more detail below.

The process used to isolate the conditions that would affect the trajectory 46 of small arm projectiles fired from a firearm 28 may be gathered from portable weather stations and chronographs. The computations of the ballistic solution as the projectile 106 is fired may be provided by the ballistics software application. Such software applications output calculations based on the variables of the firearm caliber and the characteristics in live round trajectory 46 may serve as input to the UMTS. The marksman in one example would have zeroed his firearm when the point of aim 38 is aligned with the point of impact either at a live fire target distance 94, or at a calculated point of impact 32.

One novel feature of one example of the UMTS is the interaction/connection that the UMTS 20 provides between hardware and software that allows a marksman to use his firearm 28 as the input device for point of aim 38 and center of bore alignment (emission beam 36) variables into the display app. The bore alignment point 34 that is projected by the chamber insert 74 may be recorded by the app or the software application.

To minimize the effects of manufactured tolerances (MT) the UMTS in one example can set a reference point based on industry processes on given products that are used to determine the output of the UMTS. The tolerances of a given piece of equipment (firearm or cartridge) are known, at least to some degree. Standards could be established on MT and this reference point is the departure point for wear and factors assigned to the wear that would account for these effects on the age/wear/tear on the equipment (firearm).

Another novel feature is the utilization of the graphic display 26 on a display device 24 in a single component such as a smart phone or equivalent. No known system so connects the marksman, their firearm and non-standard conditions in a graphical display 26 that can be used in one example with a game engine and mapping software that allows a virtual fly over or other simulation of the area to be simulated. The graphic display 26 in one example as shown in FIG. 4 displays the point of aim 38, calculated point of impact 32. With a gaming engine and the use of a mapping program the display device 24 could allow the marksman to virtually engage an opposing force (opponent) on actual ground such as a trail, road or route for a combat patrol. The gaming sub-system would take outputs from various programs to determine a zero from the best available data on known conditions.

The UMTS would take into account that a zero at Fort Benning, Ga. or Fort Drum is different than a zero in Nuristan or Kandahar Afghanistan and provide to the marksman a sight target 56 appropriately adjusted to the bore alignment point 34 or center of bore to the desired conditions and location.

One additional novel component of the UMTS concept is the incorporation of a laser self-guided bullet. The Sandia National Lab has announced in a news release the creation of such a self-guided bullet. In the news release Scandia mentions that the projectile has an optic sensor to detect a laser beam that will guide the bullet to the target. Given that we know what a ballistic trajectory looks like and the measurement of the known conditions, such a bullet would allow long range shooting with more precision than available without such guidance. The actual trajectory 46 and ballistics characteristics of any particular firearm 28 and can use this ballistics/trajectory in future live-fire or simulated shots. Additionally, the ballistics trajectory 46 can be determined in a particular set of conditions, and the ballistics data for that situation can be incorporated into all firearms 28 being fired in that situation. Weather (wind, temp, barometer, etc.), elevation, etc. play a part in such data analysis. As this bullet is developed the feasibility to incorporate into the UMTS data from a real time trajectory 46 become reality.

If the residuals are isolated, then a measurement of the effect of non-standard conditions would provide data to the Display App which would incorporate the residuals to determine a new zero sight setting. For example where a military unit of 100 marksmen has zeroed to expected field conditions at a deployment center and has recorded all conditions present when they went to the field, the sight alignment need not be adjusted once the marksman has reached the field. One example group used 1000 live rounds and the support infrastructure that must be used at the range, such as targets, firearm lubrication, and firearm cleaning material to initially life-fire zero their firearms was a large expense in money and time. This expense can be significantly reduced or eliminated by the disclosed system. When the unit arrives for example in Afghanistan a .50 caliber projectile formed to give the same ballistic coefficients at the range from 300 to 800 meters as the ammunition they will fire in combat may be used at an estimated target distance in the environmental conditions present. When firing one of these projectiles, measuring the vertical and horizontal deviation from the point of aim to point of impact would give the total deviation. Subtract the residual of this 0.50 projectile and it would provide the true real time deviation from non-standard conditions that would be added to every firearm 28 to derive a new accurate predicted zero from the live fire zero at a deployment center to the field in Afghanistan. This could be done in conjunction with a life-fire range firing to show how close the zero established virtually from the data is to actual live-fire results. This would instill confidence in the effectiveness of such a self-guided bullet.

In this scenario the savings in time and money of the disclosed UMTS would be substantial. To calculate the savings, one must consider all that would go into planning and resourcing equivalent live-fire training in a combat zone. The UMTS used in conjunction with a laser self-guided projectile could then become even more cost effective.

Another perceived use and advantage of the UMTS is a gaming/entertainment aspect. Simulated shooting could be incorporated as an important part of training, to acquire the skills that create muscle and cognitive memory for the engagement of opposing forces. UMTS allows the marksman to practice in a personal virtual environment those skills at many locations, including those where live-fire practice is unsafe or otherwise undesired.

While the embodiments shown in FIGS. 1-7 show use of the UMTS 20 with iron sights 92, the embodiments shown in FIG. 8, 13, 14, 22 discloses the use of an optical sight 72. The sight shown is a common "red dot" sight, but other closed, optical, and or telescopic sights can be used.

Figure 10:
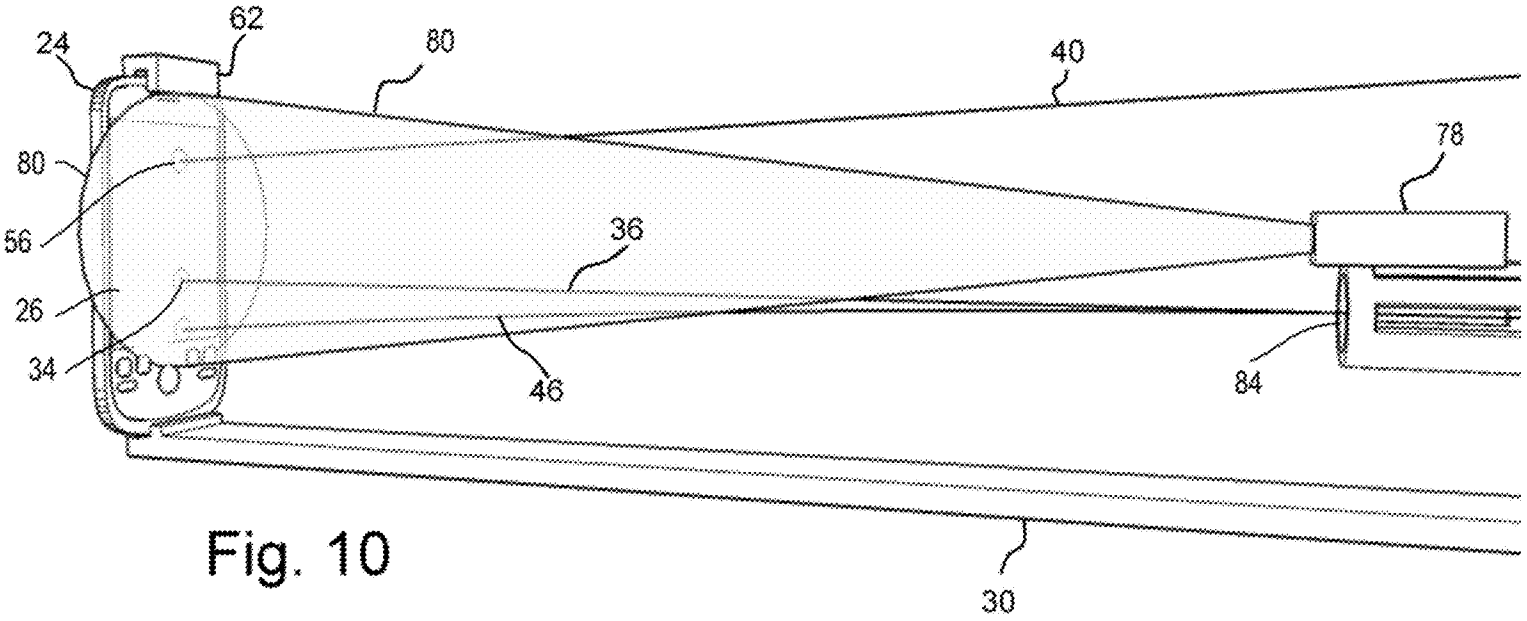
FIG. 10 is a perspective view of one example of the disclosed system.

In one form as shown in FIG. 10, the UMTS 20 utilizes motion plus or 3D motion tracking technology (sensor) 78 that locates the position of the display device 24 and/or track the firearm's position in relationship to the sight target 56 presented on the graphic display provided that the display device is within the sensor's field of view 80.

In one form, the sensor 78 will detect the location of the bore alignment point 34 as the bore line 36 from the chamber insert intersects the display device 24. The display device 24 may also display to the marksman the location of the sight target 56 and/or bore alignment point 34 on the graphic display.

Figure 11:
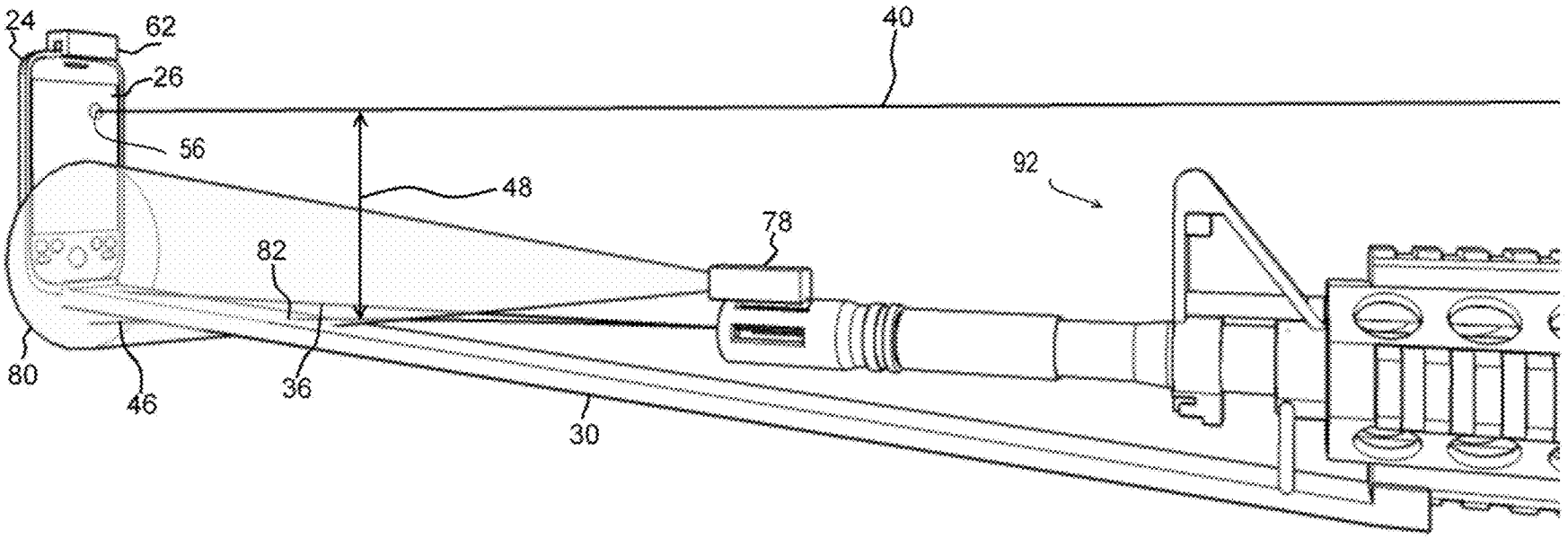
FIG. 11 is another perspective view of one example of the disclosed system.

In the configuration shown in FIG. 11, the emission beam 36 and the simulated trajectory 46 do not intersect with the graphic display 26. In some applications, where the vertical offset 48 between the sight line 40 and bore line 36 is greater than the widest (tallest) dimension of the graphic display 26 or the display device 24, the emission beam 36 and/or the simulated trajectory 46 may not intersect with the graphic display 26 or the display device 24. In the embodiment shown in FIG. 11, it can be seen how the emission line 36 impacts the positionable arm 30 generally at location 82. The sensor 78 may detect the emission line 36, the point of intersection 82, or may be independent of the emission line altogether. Where an optic sight 92 such as a scope is used above the bore 84 of the firearm 28, such a vertical offset is not uncommon. Attachment systems such as the Picatinny system shown may exacerbate the offset distance 48.

In such an application, the use of a sensor 78 is especially helpful, provided that at least an identifying part of the apparatus can be detected by the sensor 78. In FIG. 11 for example, at least the lower portion of the display device 24 is within the field of view 80 of the sensor 78. As such, the sensor 78 will detect the position and orientation of the display device 24 and be able to properly and accurately provide a sight target 56 to the shooter.

In one form, the sensor 78 may be used to accomplish the alignment functions of the chamber insert 74, and may be placed in, around, or on the barrel or bore of the firearm 28 using connection configurations such as components 100*a* of FIG. 13 which fits (partially) into to muzzle end 88 of the bore 84 or component 100*b* which is threaded onto the muzzle end 88 of the bore 84.

Connectivity between the display device 24 and the chamber insert may be established by a hard (wire) data connection 102 or wireless connection such as a Bluetooth Radio, or WiFi.

The Display App in one form may establish the distance and relative position/alignment of the chamber (or other portion) of the firearm 28 to the sensor 78 and use this relative position/alignment to project the images, including for example the sight target 56, that is shown on the graphic display 26. In one form, the marksman will visually perceive a target or a target scenario that is visually corrected by the program to portray an actual distance in a simulated environment. The software application in one form will also have the capability to determine corrections for angle (elevation angle) from the sight location to the emission beam 36 at the sensor 78 location. This determination may allow the Display App to correctly display the corresponding sight picture at various distances. The sight picture being the superimposition of the sights on the target.

In one example, a remote control device 108 may be utilized to manipulate the Display App and/or the display device 24. The remote device example shown in FIG. 13 may be a device attached to the wrist of the marksman. In some examples, the remote control device 108 is connected wirelessly to the display device 24 such as through WiFi, Bluetooth, radio, infrared (IR), or other connections.

Figure 15:
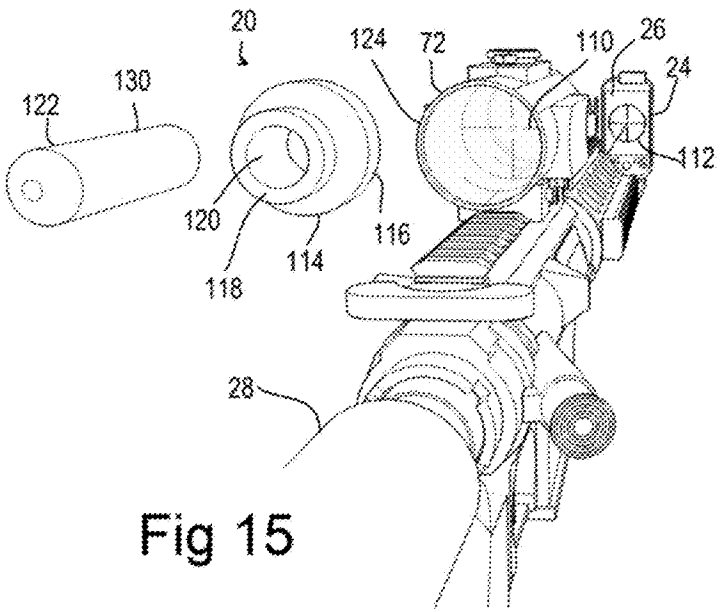
FIG. 15 is a rear perspective enlarged and separated view of the example shown in FIG. 14.

In another example as shown in FIG. 15 hardware and software are used in combination to display a reticle image 112 of the reticle 110 of the optical sight 72 on the display screen 26.

The UMTS 20 in this example shown in FIG. 15 may utilize an adapter 114 having a first end 116 that mounts at the eye piece 124 of a firearm sight 72. In this example, centered in the second end 118 of the adapter 114 is a version of a display device compatible camera 122. The camera 122 in one example is connected to the display device 24 by data wire 132 or wireless connection. The camera 122 in one example records a reticle image 112 of the reticule 110 and provides the display device 24 with a video signal to the display device 24. The display device 24 would display the reticle image 112 of the reticle 110 on the graphic display 26 and the apparatus in one example would have a way of focusing the image 112 of the reticle 110 on the graphic display 26. The camera in one example is integral to a display/computing device (smart phone). For example, the assembly shown in FIGS. 14 and 15 may alternatively utilize a camera/computing device optically connected to item 130.

In this example, the marksman in not looking through the optical sight 72, instead the marksman is looking at the graphic display 26 of the display device 24 and views what the camera 122 records. The Display App in one example will allow the marksman to reposition images to the reticle image 112 and align those displayed images to the reticle image 112. This repositioning in one example may be accomplished by moving one image at a time, up, down, left, right and in one example being able to rotate the image of a grid 128 to precisely align with the reticle image 112. In one example, the marksman will repeat these steps with three different images that verify the positioning of the last image in sequence. Once this is done the alignment of images is recorded in the Display App providing a visual record of the alignment.

The importance of this recording is apparent when the marksman suspects that his optical sight 72 may have been disturbed and wants to verify and confirm that the point of aim 38 and the impact of projectiles 106 still coincide at specified conditions. The firearm 28 could have fallen, jarring and possibly misaligning the sights 92, the marksman could have fallen with the firearm 28 or the optical sight 72 may have been removed for some reason and placed back on the firearm 28.

Figure 14:
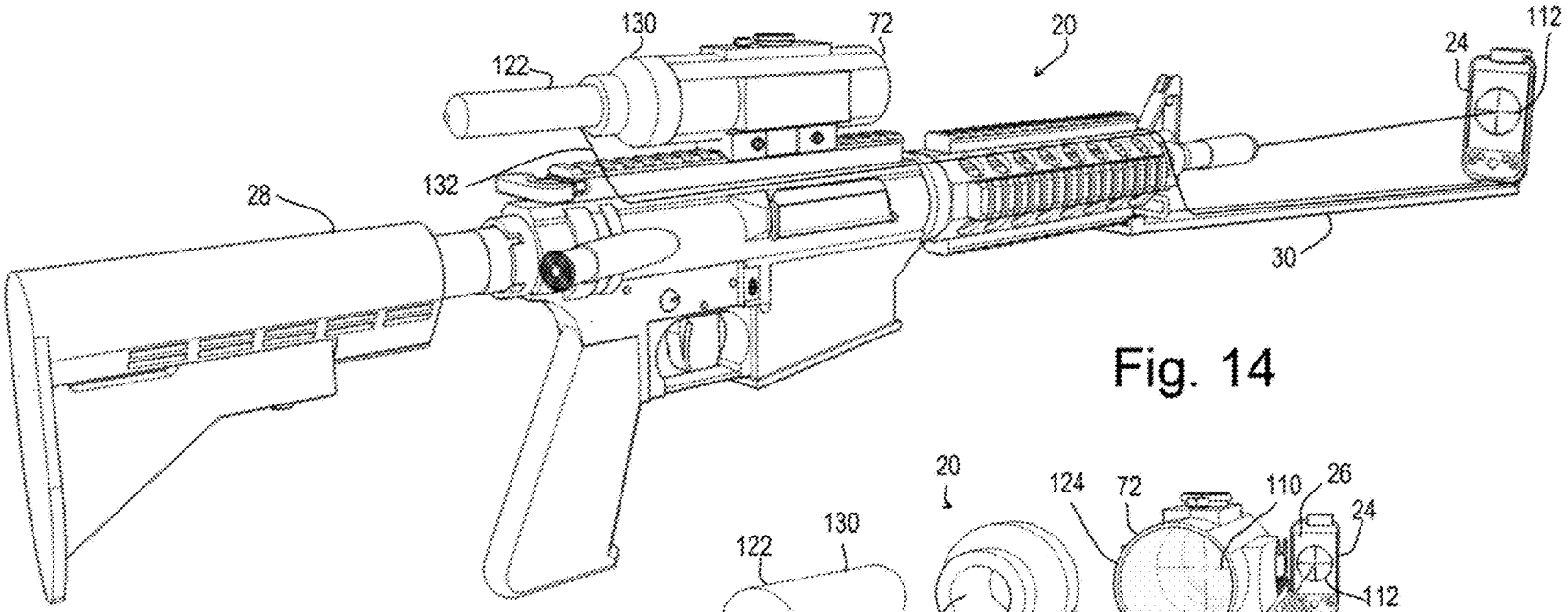
FIG. 14 is a side perspective view of another example of the apparatus.
Figure 17:
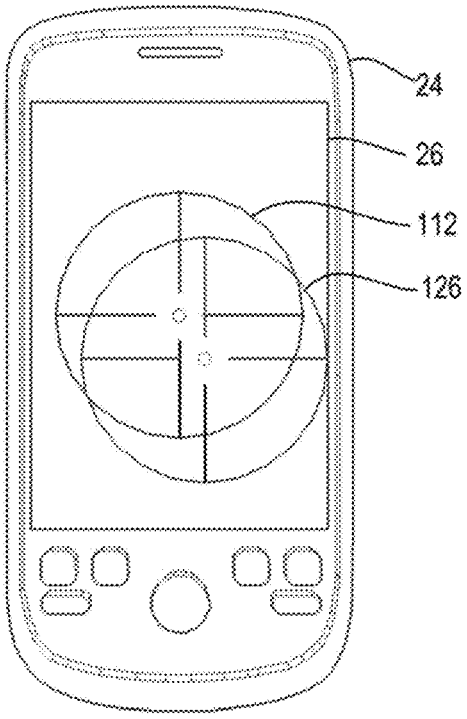
FIG. 17 is a face view of the displace device shown in FIG. 16 projecting a live image which is not aligned with a zero image.

To verify the zero of the firearm using the example shown in FIG. 1 following a potential misalignment of the sights, the marksman places the apparatus (including for example adapter 130, camera 122, arm 30, and display device 24) in position as shown in FIG. 14. The marksman then turns the Display App on, and the Display App will display the reticle 110 of the sight 72 on the display device as a displayed reticle image 112. In one example, the Display App contains an instruction routine which will instruct the marksman for the procedure of alignment to be followed. The Display App in one example will request if the marksman desires to confirm his zero, and if confirmed will compare the two images (recorded zero image 126 and live image 112 transmitted by camera 122). In one example, the alignment procedure on both images takes out the error of cant (rotational twist of the assembly) and allows the comparison of change between the reticle image 112 and the zero image 126 (FIG. 17).

Figure 16:
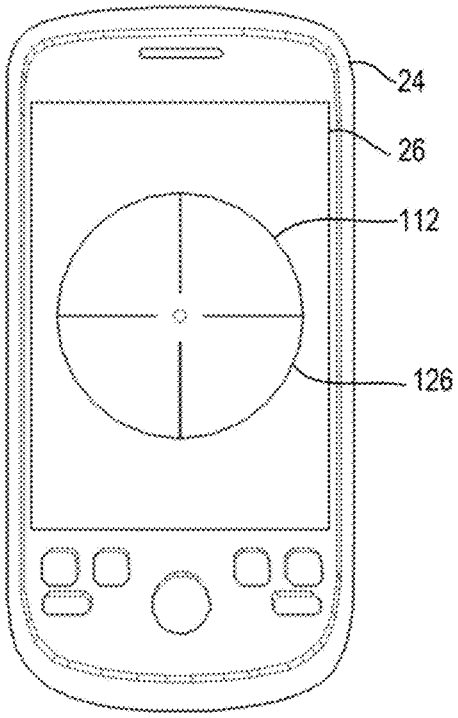
FIG. 16 is a face view of a displace device component of the example shown in FIG. 1 projecting a live image aligned with a zero image.
Figure 19:
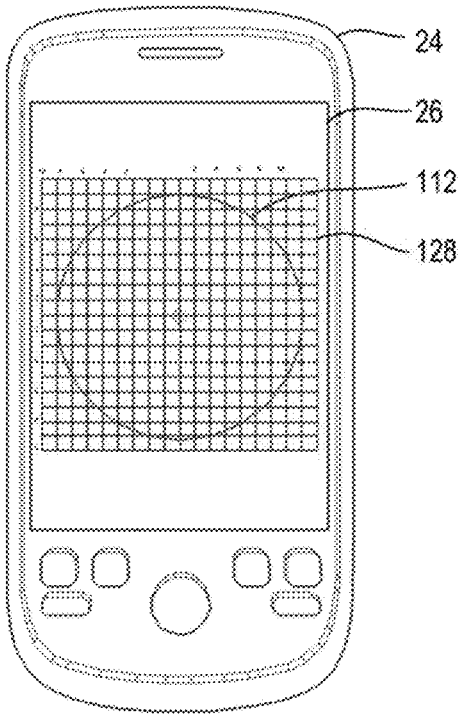
FIG. 19 is another view of the display device shown in FIG. 18 with a different alignment picture.
Figure 20:
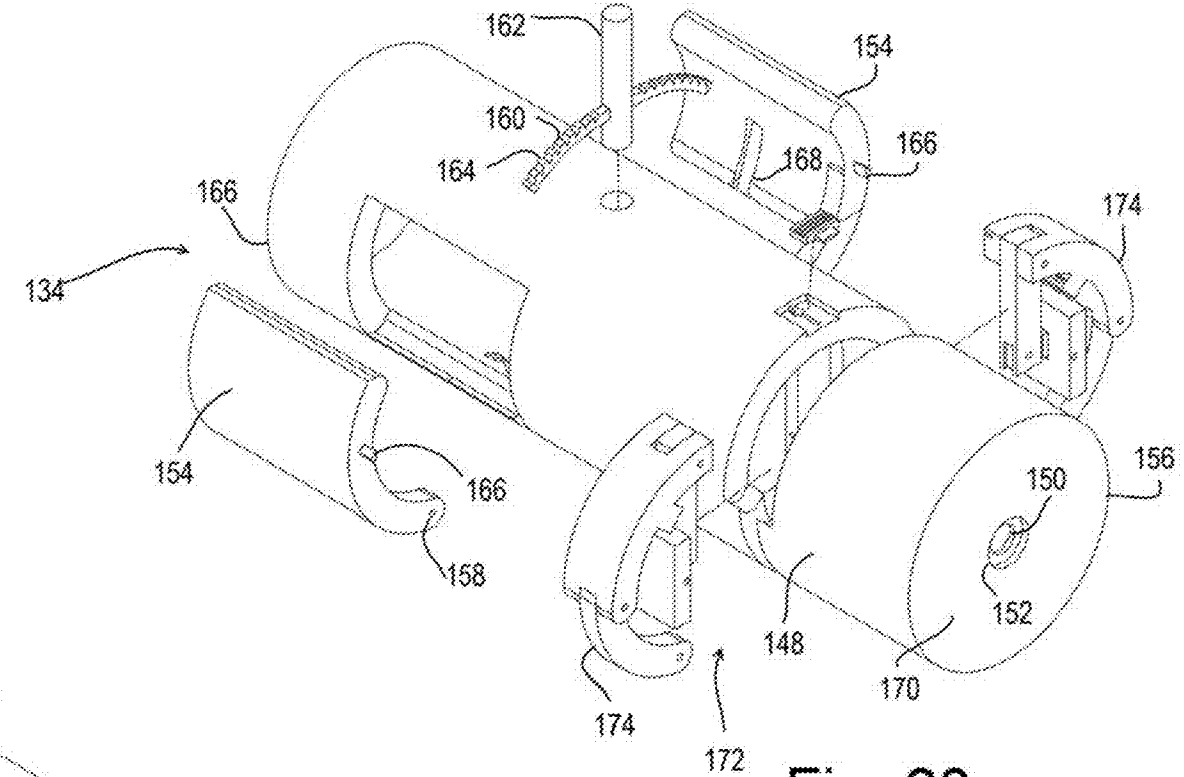
FIG. 20 is a perspective view of another example of a chamber insert made to be adjustable to self-center in chambers of varying diameters.
Figure 21:
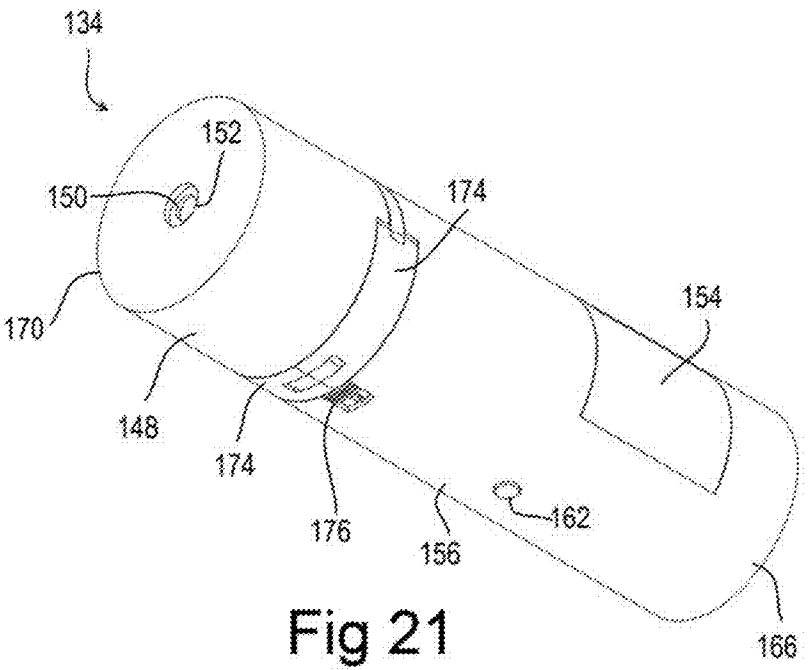
FIG. 21 is an assembled view of the chamber insert shown in FIG. 20.

If the zero image 126 and reticle image 112 align, the zero has not moved as seen in FIG. 16 with the reticle image 112 overlaid on the recorded image 126 of zero. If the zero image 126 and reticle image 112 do not align, the zero has moved as is easily seen in FIG. 17 with the reticle image 112 overlaid adjacent the recorded image 126 of zero The marksman is then confident that the zero of his firearm has not shifted and can store the UTMS apparatus (including for example adapter 130, camera 122, arm 30, and display device 24). If the recorded and live images do not align, then the Display App in this example will show the variance of the live image is from the recorded image on the grid as shown in FIG. 18. A grid alignment is shown in FIG. 19. The marksman can either reposition the reticle back to the recorded image by adjusting the sight 72 to the virtual image on the graphic display or may re-zero at a live-fire range.

Through testing and experience gained with this method the marksman would not have to live-fire re-zero and would have confidence in the corrections provided by the UMTS 20. Thus achieving the benefits disclosed herein.

In one example, where the display device includes a video recording device (camera) on the side opposing the display screen 26, the Display App may be configured to display the video perceived by the camera to the display screen 26. In such an example, a sight target 56 may be overlaid upon the video such that the display screen 26 is effectively invisible as a marksman views down the sight line 40 of the firearm.

Another example utilizes an adapter that mounts on the rifle scope eye piece. The phone camera will display the images from the app for the recording of zero that represents the accounting of all variable that can affect the trajectory of the bullet. This sight setting corresponds to the rifle scope setting that results in the point of aim to match the point of impact. The app of one example will be configured to rotate the image of crosshairs and a grid sheet and align the crosshairs image up and down much like the knobs that are used on an rifle optical sight and as noted in the screen shots (FIGS. 26, 30, 32, 33, 35, and 37 of the app.

If the same routine used to set up the record of the sight setting when the weapon was zeroed and then when one desires to check or suspects something may have affected zero then the variance can only be the variation from the first image (zero) to the second image (suspect). This variance may amount to nothing or the shift that indicates the change from the time of the first image to the second image due to whatever condition caused the necessity for the check.

The sensor that may be used in the chamber insert may be an acoustic proximity sensor, a capacitive proximity sensor, or equivalents.

An acoustic proximity sensor works on the same principle as sonar. A pulsed signal, having a frequency somewhat above the range of human hearing, is generated by an oscillator. This signal is fed to a transducer that emits ultrasound pulses at various frequencies in a coded sequence. These pulses reflect from nearby objects and are returned to another transducer, which converts the ultrasound back into high-frequency pulses. The return pulses are amplified and sent to a controller. The delay between the transmitted and received pulses is timed, and this will give an indication of the distance to the obstruction. The pulse coding prevents errors that might otherwise occur because of confusion between adjacent pulses.

A capacitive proximity sensor uses a radio-frequency (RF) oscillator, a frequency detector, and a metal plate connected into the oscillator circuit. The oscillator is configured so that a change in the capacitance of the plate, with respect to the environment, causes the frequency to change. This change is sensed by the frequency detector, which sends a signal to the apparatus that controls in one example, a robot. In this way, a robot can avoid bumping into things. Objects that conduct electricity to some extent, such as house wiring, animals, cars, or refrigerators, are sensed more easily by capacitive transducers than are things that do not conduct, like wood-frame beds and dry masonry walls.

Returning to an example utilizing a chamber insert 134 with a flag 140 projecting therefrom, while looking to the example shown in FIG. 27, the camera 122 has captured an image of the sight picture through the sights 92 and this image also captures the position and orientation of the flag 138. This is diagrammatically shown in FIG. 25 and is shown in the screen shot (capture or photo) of FIG. 26. The display app then may display to the shooter the bore alignment point 34 relative to the sight picture.

Figure 31:
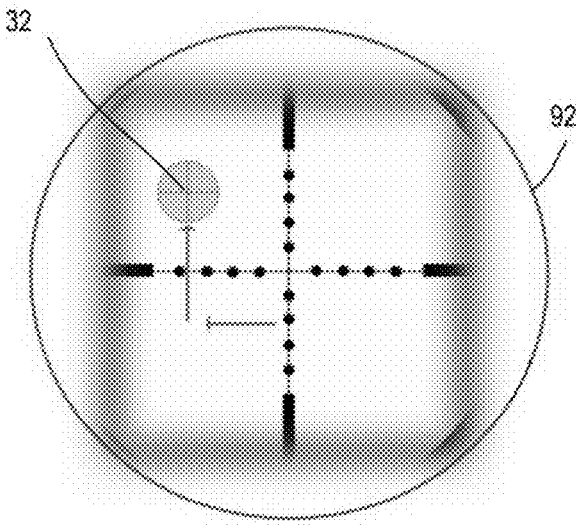
FIG. 31 diagrams one step of an alignment process.
Figure 32:
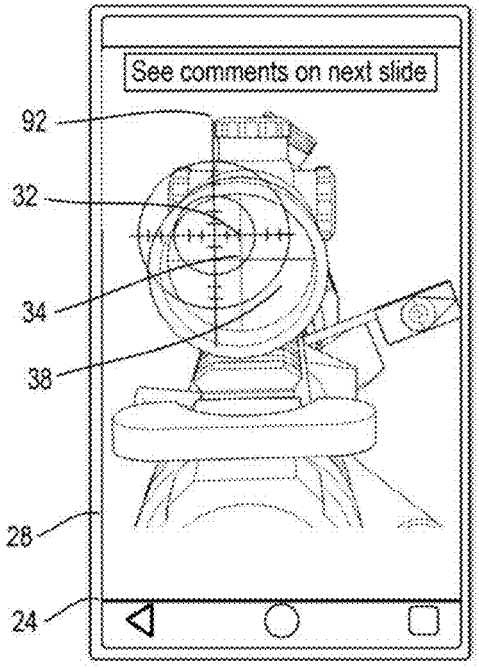
FIG. 32 is a screen shot of the sight picture shown in FIG. 31 as seen through a display device.
Figure 33:
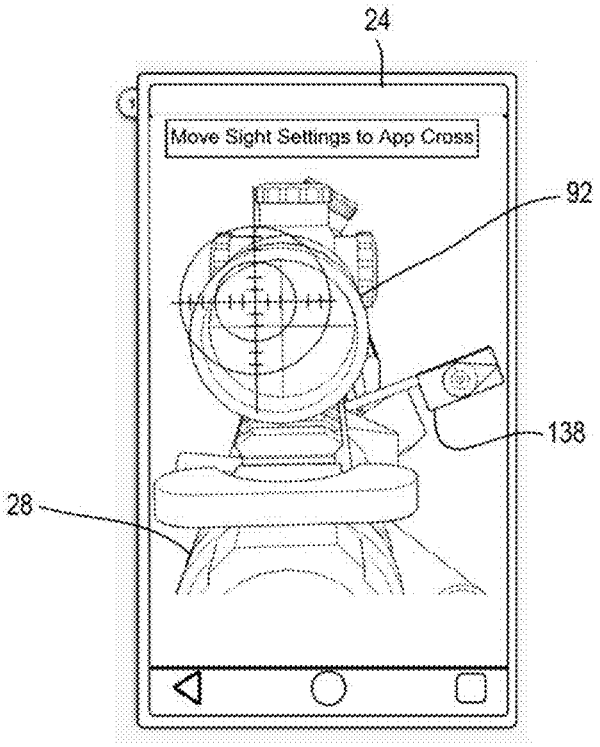
FIG. 33 is another screen shot of the sight picture shown in FIG. 32.
Figure 34:
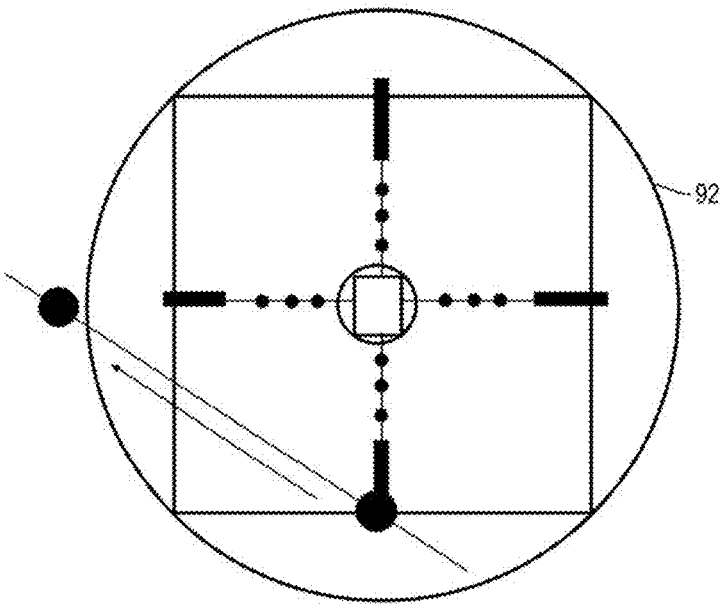
FIG. 34 diagrams another step of an alignment process.

Looking to FIG. 32, the display app may also be configured to show the marksman the relative position of the calculated point of impact 32 relative to the bore alignment point 34 and point of aim 38. As shown in FIG. 31, the display app may then instruct the shooter, the direction and distance which to adjust the sights.

Figure 35:
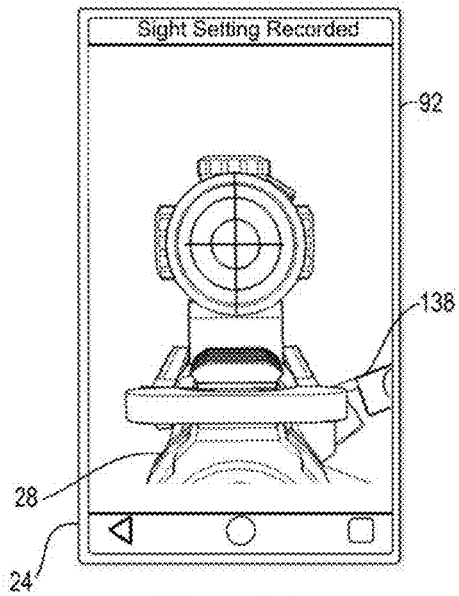
FIG. 35 is a screen shot following the step shown in FIG. 33
Figure 36:
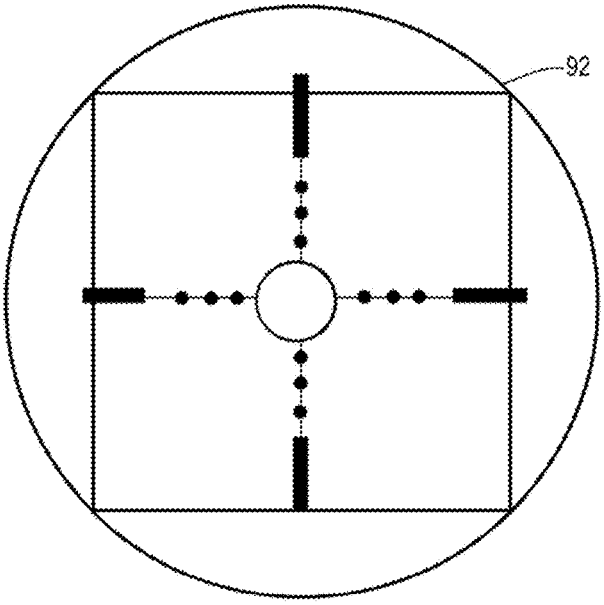
FIG. 36 diagrams a later step in the example shown in FIG. 34.
Figure 37:
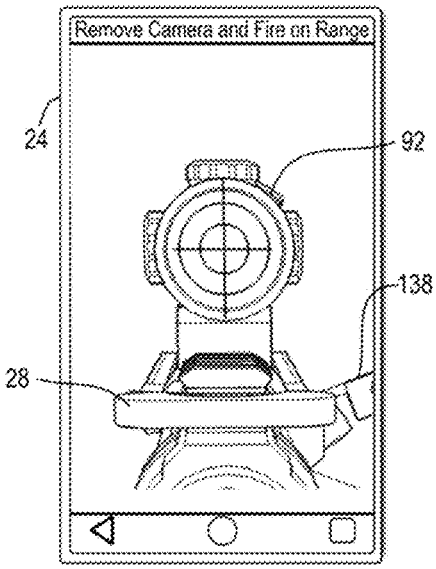
FIG. 37 is a screen shot following the step shown in FIG. 35.

Following adjustment of the sights, another picture may be taken as shown in FIG. 35, whereupon the display app re-calculates one or more of the center of bore, sight alignment, point of impact, point of aim, and bore alignment point and displays the current adjustment to the shooter.

Figure 26:
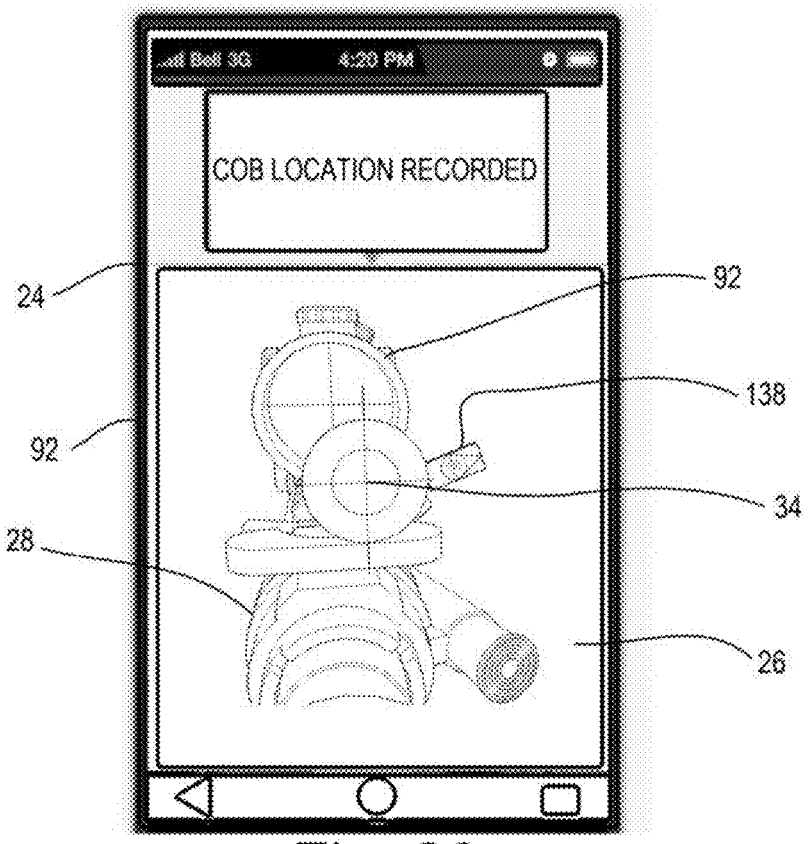
FIG. 26 is a screen shot of the process step shown in FIG. 25.

If the point of aim 38 is within acceptable tolerances to the calculated point of impact, the display app may indicate an acceptable zero to the marksman. In FIG. 26, the display app has displayed "Weapon is Bore Sighted!" to the shooter.

Figure 22:
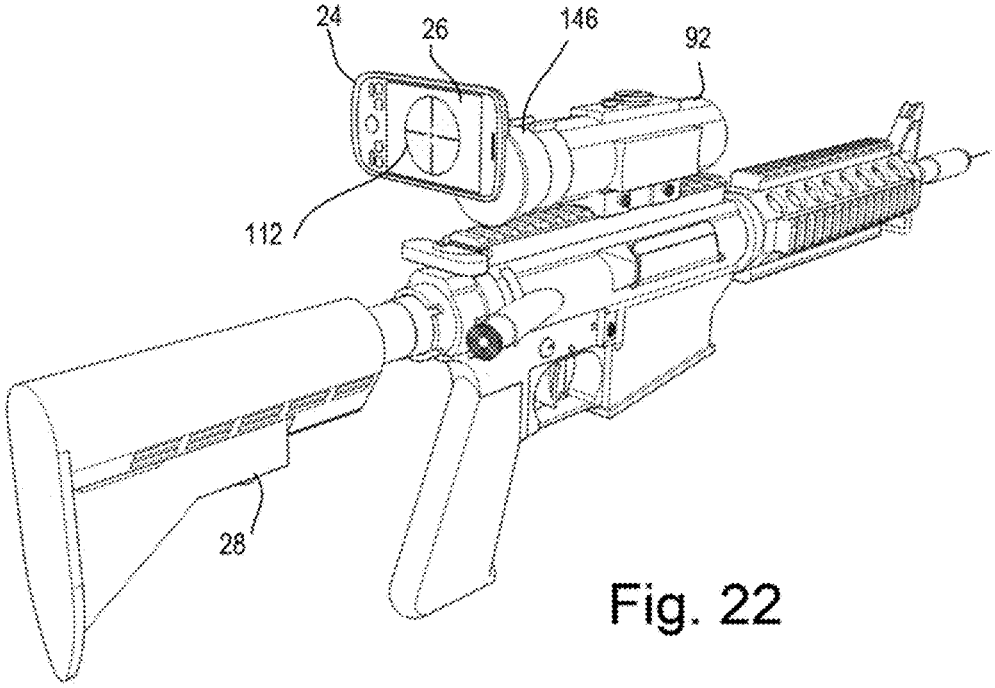
FIG. 22 is a rear perspective view of a display device mounted to align a camera component with the sights of the firearm.
Figure 23:
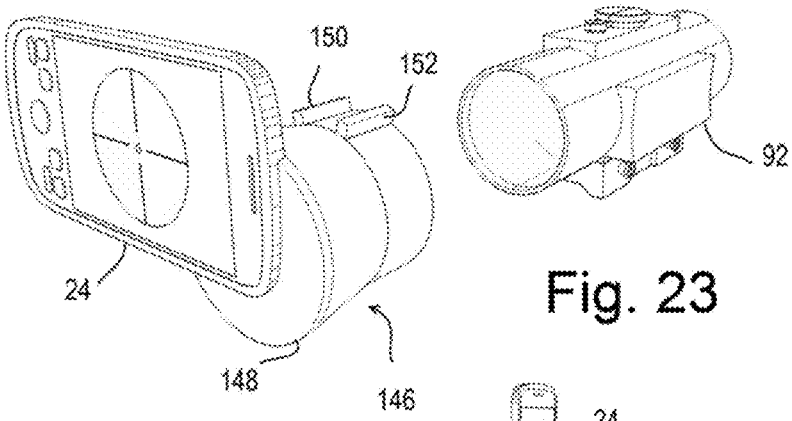
FIG. 23 is an enlarged and separated view of several components shown in FIG. 22.
Figure 24:
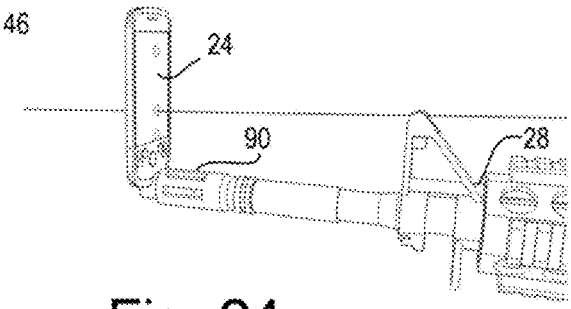
FIG. 24 is a variation of the display device holder shown in FIG. 1, fitted into the muzzle of the firearm.
Figure 25:
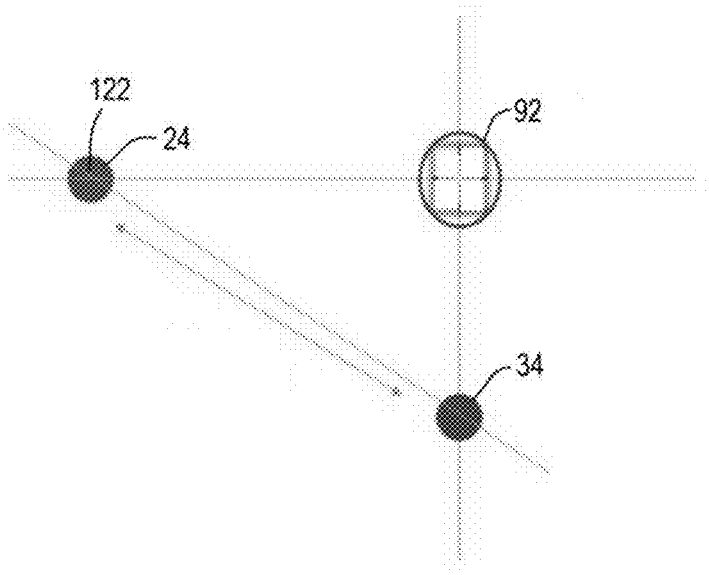
FIG. 25 diagrams another example of a sight alignment process.

Looking to FIGS. 22-23 is shown an example where the display device 24 is mounted to the firearm sight 92 by way of an adapter 146 such that the camera 122 thereof is aligned with the reticle 110. In one example, the adapter 146 comprises a spring-compressive clamp 148 attaching to the rearward end of the sight 92. One or more engagement surfaces 150, 152 may be provided to be actuated by the user to dis-engage the clamp 148 and remove the adapter 146. As seen, the reticle 110 of the firearm is projected onto the display device 26 as a reticle image 112.

Figure 43:
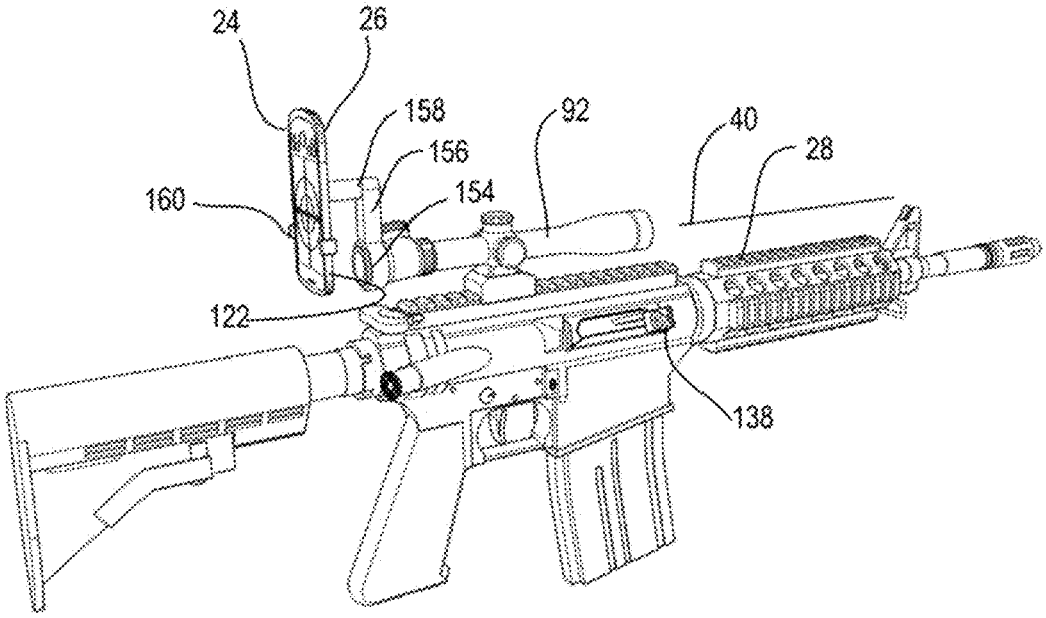
FIG. 43 is a perspective view of an example utilizing a pivoting version of a display device mount.
Figure 44:
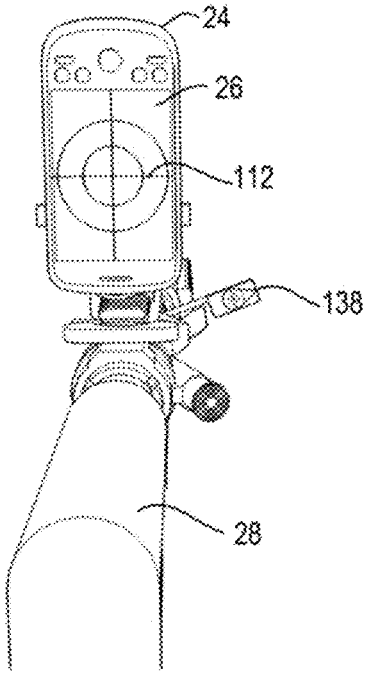
FIG. 44 is a rear view of the example shown in FIG. 43 in a first position.
Figure 45:
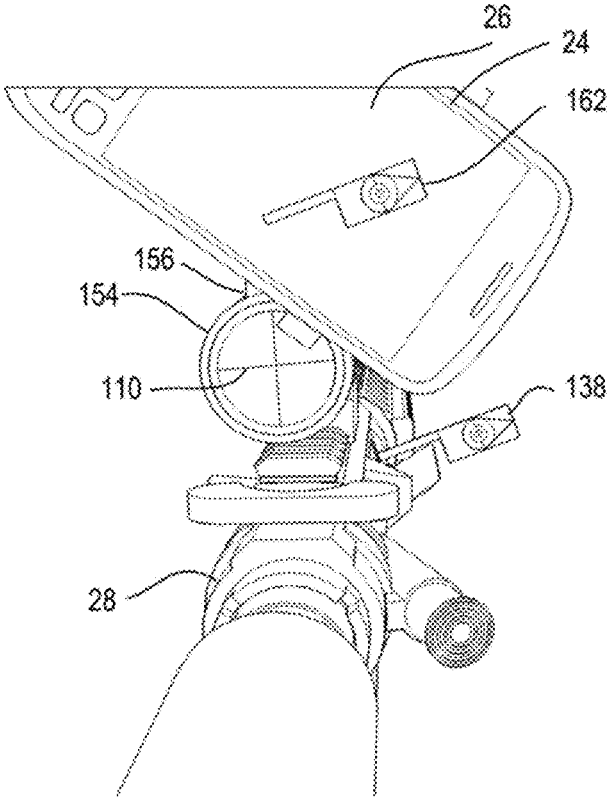
FIG. 45 is a rear view of the example shown in FIG. 43 in a second position.

Looking to FIGS. 43-45 is shown an example with an adapter mounted to the sight 92 of a firearm 28. In this example, the adapter 154 includes an offset arm 156 extending radially outward from the sight alignment line 40 and having a pivot 158 thereon. The pivot 158 connected to a clamp 160 which engages or is adhered to the display device 24 at a location offset from the camera 122.

The adapter 154 configured to align the display device 24 in a first position (FIG. 44) where the camera 122 is aligned to image the reticle 110 of the sight 92 and optionally project a reticle image 112 on the graphic display 26.

The adapter 154 also configured to rotate the display device 24 to align the camera 122 offset from the reticle 110, such that the camera 110 captures an image of the flag 138 and may project a flag image 162 on the graphic display 26.

The display app configured to compare the position of the flag 138 relative to the reticle 110 or other component of the sight 92 and determine any offset from the zero and indicate to the marksman any adjustment needed.

In one example, the rotational angle of the adapter 154 is precisely set to allow the display app to make the needed calculations, in other examples reference points are captured by the camera 122 in each position and used to calculate any offset from zero.

Figure 40A:
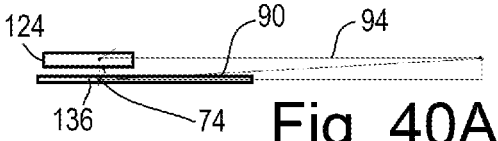
FIG. 40A is another view of the components of the system shown in FIG. 27.
Figure 40:
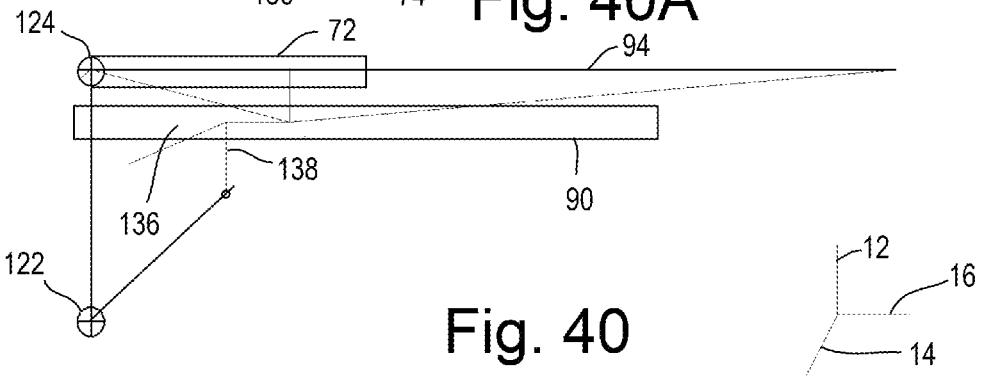
FIG. 40 diagrams the components of the system shown in FIG. 27 in use.

Looking back to FIG. 40 is a highly schematic example of the disclosed apparatus showing the flag 138 extending outward from the chamber 136 a distance of 2". In this example, the camera 122 is positioned 4 transversely away from the eyepiece 124 a distance of 4" using one of the mounting devices shown herein. Thus the position of the camera 122 relative to the eyepiece 124 is known very accurately due to the structural nature of the mounting device. Also, the relative position and distance of the flag 138 to the eyepiece 124 can be visually determined by the camera 122 and associated circuitry. Thus, the relative position and distance of the sight 72 to the barrel 90 can be calculated and the correct zero of the firearm verified or corrected.

Figure 46:
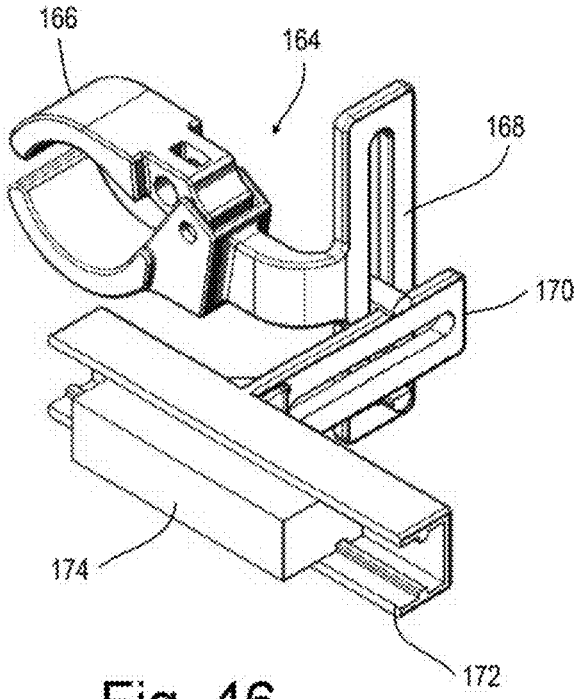
FIG. 46 is an alternate example of the adapter shown in FIG. 22.
Figure 47:
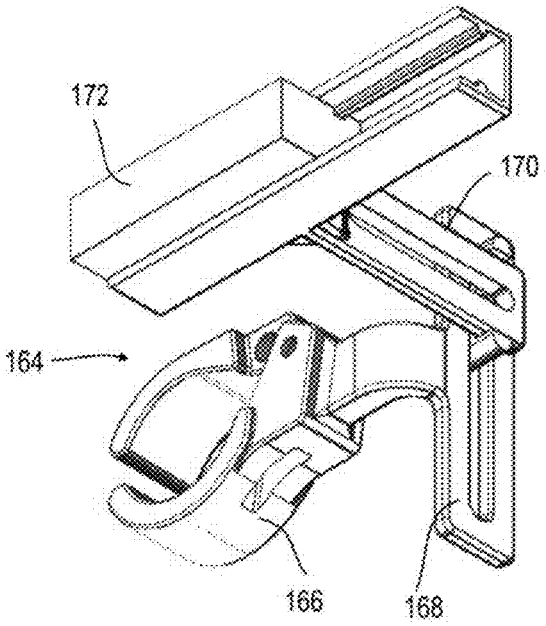
FIG. 47 is another view of the adapter shown in FIG. 46.
Figure 48:
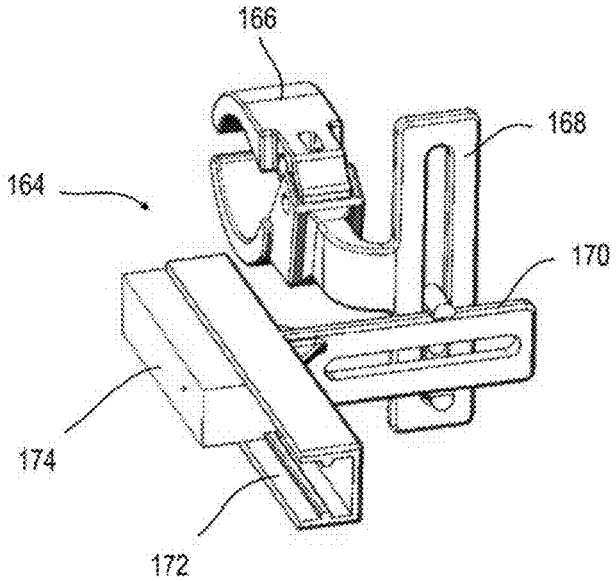
FIG. 48 is another view of the adapter shown in FIG. 46.

Looking to FIG. 46-48 is shown another example of an adapter 164 configured to mount a device, such as for example the display device 24 having a camera 122 to a firearm 28. In this example, the adapter 164 allows linear repositioning along the vertical 12, transverse 14, and longitudinal 16 directions.

In this example, the adapter 164 comprises a clamp 166 which mounts to the sights 92 or other component of the firearm 28. In this example, the clamp 166 removably attaches to the firearm 28 without the need for tools, and without leaving any marks or adhesives on the firearm 28 when removed.

In the example shown in FIG. 46, fixed to the clamp 166 is a vertical slide 168. The vertical slide 168 configured to allow vertical repositioning of the camera 122 relative to the clamp 166, or transverse repositioning when mounted in another orientation. This vertical slide assisting in the alignment of the camera 122 with the center of the sight 92 for proper alignment, viewing, and calculation as previously described.

This example also utilizes a longitudinal slide 170, allowing for alignment of the camera 122 with the eyepiece 124 of the sight 92 for proper alignment, viewing, and calculation as previously described.

The longitudinal slide 170 allows the user to move the camera 122 along the line of sight to properly focus the device relative to the sights 92 and sight picture.

The adapter 164 of this example also has a transverse slide 172 mounted to the longitudinal slide 170. The transverse slide 172 utilizing an attachment 174 which mounts to the camera 122 for proper alignment, viewing, and calculation as previously described.

The transverse slide 172 also allowing for transverse movement of the camera 122 transversely away from the sights 92 a specific pre-set or calculable distance to allow the camera 122 to view the flag 138 when not aligned to the and thus determine the relative position of the chamber 136 to the sights 92. As discussed in various examples above, this allows the system 20 top calculate and assist the shooter in verifying or adjusting the zero of the firearm 28.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

Therefore I claim:

1. A universal marksmanship training system for a firearm, the training system comprising:

a display device mounted to the firearm, the display device comprising a graphic display;

a display app configured to display a virtual target on the graphic display;

wherein the display app is configured to determine a bore alignment relative to the sights of the firearm;

wherein the display device displays on the graphic display a calculated point of impact of a projectile calculated from ballistics data and the bore alignment;

wherein the virtual target is visually perceived by a marksman, and is offset from the calculated point of impact by an offset distance; and wherein the display app calculates the position of the virtual target relative to the calculated point of impact given a set of condition variables and the bore alignment, wherein the display app is configured to allow the marksman to adjust the sights of the firearm to align the virtual target with the calculated point of impact to zero the firearm.

2. The training system as recited in claim 1 wherein the condition variables are selected from the list consisting of:

elevation of a live-fire target relative to the firearm;

weather conditions at the live-fire target;

ballistic characteristics of the firearm;

ballistics characteristics of a cartridge to be fired;

distance from the firearm to the live-fire target; and marksman firing offset.

3. The training system as recited in claim 1 further comprising a display device support arm comprising:

a first end attached to a muzzle end of the firearm; and a second end comprising a display device attachment bracket configured to attach to the display device.

4. The training system as recited in claim 3 wherein the support arm is positionable so as to align the display device relative to the bore of the firearm.

5. The training system as recited in claim 1 further comprising sights selected from the list consisting of iron sights, an optical sight, and a red dot sight mounted to the firearm.

6. The training system as recited in claim 1 wherein the offset distance is relative to the offset between the alignment point of the sight and the center of the firearm bore.

7. The training system as recited in claim 1 comprising a chamber insert configured to be positioned within the chamber of the firearm, wherein the chamber insert comprises a flag, extending transversely out of the chamber and visible to a camera communicating with the display device.

8. The training system as recited in claim 7 wherein the display device is positioned rearward of the sights of the firearm and rearward of the flag of the chamber insert so as to capture the sight picture of the sights and the position of the flag.

9. The training system as recited in claim 7 wherein the display device is mounted to the sights of the firearm.

10. The training system as recited in claim 9 wherein the display device is transversely repositionable relative to the sights of the firearm while mounted to the sights of the firearm.

11. A universal marksmanship training system for a live fire firearm, the training system comprising:

a display device comprising a graphic display;

a software application configured to display a virtual target on the graphic display;

a sensor which detects the position of the display device relative to the position of the firearm;

wherein the sensor interacts with the software application to determine alignment of a bore of the firearm relative to the display device;

wherein the virtual target is visually perceived by a marksman, and is offset from the bore alignment point by a offset distance; and wherein the software application calculates the position on the graphic display of the virtual target relative to the bore alignment point of the firearm given a set of condition variables.

12. A universal marksmanship training system for a live fire firearm, the training system comprising:

a firearm comprising a barrel and a sight having a sight picture;

a display device removably attached to the firearm along a sight line of the firearm, the display device comprising a graphic display;

a camera attached to the sight so as to capture the sight picture of the firearm; and a display app coupled to the camera and configured to display and record an image including the sight picture on the graphic display.

* * * * *